US006465392B1

(12) United States Patent
Ikeda

(10) Patent No.: US 6,465,392 B1
(45) **Date of Patent: *Oct. 15, 2002**

(54) HEAT-SENSITIVE RECORDING MATERIAL

(75) Inventor: Kenji Ikeda, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 177 days.

This patent is subject to a terminal disclaimer.

(21) Appl. No.: 09/595,539

(22) Filed: Jun. 16, 2000

(30) Foreign Application Priority Data

Jun. 16, 1999 (JP) ..... 11-169890

(51) Int. Cl.[7] ..... B41M 5/40
(52) U.S. Cl. ..... 503/226; 427/152; 503/200
(58) Field of Search ..... 427/152; 503/200, 503/226

(56) References Cited

U.S. PATENT DOCUMENTS 5,108,834 A * 4/1992 Asazuma ..... 428/323
5,804,528 A * 9/1998 Aoki et al. ..... 503/204
6,261,993 B1 * 7/2001 Aono ..... 503/226

* cited by examiner

*Primary Examiner*—Bruce H. Hess
(74) *Attorney, Agent, or Firm*—Sughrue Mion, PLLC

(57) ABSTRACT

A heat-sensitive recording material includes a substrate, a heat-sensitive recording layer provided on the substrate, and a protective layer provided on the heat-sensitive recording layer. When the heat-sensitive recording material is image formed by an application energy of 120 mJ/m$^2$, a surface roughness (Ra value) of an image-formed surface of the heat-sensitive recording material after image forming is 0.7 $\mu$m or less. The protective layer contains at least a long-chain alkyl ether-denatured polyvinyl alcohol, waxes, and inorganic ultra fine particles having an average primary particle size of at most 0.1 $\mu$m. The heat-sensitive recording material has excellent head properties, specifically, excellent friction resistance with respect a heat-sensitive recording head and excellent lubricity, no adherence of residues at the heat-sensitive recording head, and improved travelling property and scratch resistance, while maintaining gloss of the heat-sensitive recording material.

21 Claims, No Drawings

HEAT-SENSITIVE RECORDING MATERIAL

BACKGROUND OF THE INVENTION

1. Field of the Invention

The present invention relates to a heat-sensitive recording material, and more particularly to a heat-sensitive recording material including a heat-sensitive recording layer and a protective layer provided on a substrate. The recording material has excellent scratch resistance and causes no sticking and residue adhesion at a heat-sensitive recording head or the like because the protective layer has excellent transparency, gloss, heat resistance and light resistance, and has excellent friction resistance and lubricity with respect to the heat-sensitive recording head.

2. Description of the Related Art

Recently, there has been development of heat-sensitive recording, because recording devices for heat-sensitive recording are simple, have high reliability and need no maintenance. Conventionally materials that utilize a reaction of an electron donative colorless dye with an electron receptive compound, materials that utilize a reaction of a diazonium salt compound with a coupler, and the like are widely known as heat-sensitive recording materials for heat-sensitive recording.

Recently, studies on improvement of properties of heat-sensitive recording materials, such as (1) color development density and color development sensitivity and (2) durability and the like of color image forming materials, have been conducted intensively. However, heat-sensitive recording materials have a drawback in that when exposed to sunlight for a long time or displayed in an office or the like for a long period of time, backgrounds become colored and image portions change color or discolor because of the light. Various methods have been suggested for ameliorating coloring of backgrounds and color changing or discoloration of image portions, but satisfactory results have not been consistently achieved.

On the other hand, there is growing demand for heat-sensitive recording systems in various fields such as facsimiles, printers, labels and the like. Accordingly, heat-sensitive recording materials with greater capabilities are required. For example, when a heat-sensitive recording material is heated image wise by a heat-sensitive recording head to record images, in order to obtain smooth prints without image forming failures and good images having excellent gloss, it is necessary for dynamic friction with the heat-sensitive recording head to be reduced to a certain value or less.

Particularly, in the case of a full color heat-sensitive recording material, when sufficient heat from a thermal head is intended to be imparted to layers near a substrate, heat of a relatively high energy level is applied to a surface protective layer, and the surface tends to roughen and manifest remarkably reduced gloss.

Therefore, waxes (for example, zinc stearate and the like) and matting agents, pigments and the like have been conventionally used for imparting friction resistance and lubricity to heat-sensitive recording materials. However, such means do not provide sufficient improvements in friction resistance and lubricity, and have drawbacks in that if the heat-sensitive recording material is a reflective material, reductions in transparency and gloss thereof (and if the heat-sensitive recording material is a transparent material, an increase in degree of haze thereof) result, and further, components thereof fuse to heat-sensitive recording heads, image-formed surfaces and the like, leading to faults such as adherence of residues, gloss unevenness and the like.

SUMMARY OF THE INVENTION

The object of the present invention is to provide a heat-sensitive recording material which has excellent head properties, specifically, excellent friction resistance with respect to a heat-sensitive recording head and excellent lubricity, no adherence of residues to the heat-sensitive recording head, and improved travelling property and scratch resistance, while maintaining gloss of the heat-sensitive recording material.

The inventors of the present invention have intensively studied how to attain the above-described object, found that the object can be attained if a surface of the heat-sensitive recording material after image forming has a particular surface roughness, and completed the invention. Namely, the above-described object of the present invention is achieved by providing heat-sensitive recording materials having the following characteristics (a) to (g).

(a) In a heat-sensitive recording material including a heat-sensitive recording layer and a protective layer provided on a substrate, wherein when image is formed on said heat-sensitive recording material by an application energy of 120 $mJ/m^2$, a surface roughness (Ra value) of an image-formed surface of the heat-sensitive recording material after image forming is at most 0.7 $\mu$m. The heat-sensitive recording material having the surface roughness of the image-formed surface as described above has excellent friction resistance with respect to a heat-sensitive recording head and excellent lubricity, causes no adherence of residues to the heat-sensitive recording head, and has improved travelling property and scratch resistance (head properties), while maintaining gloss.

(b) In the heat-sensitive recording material of (a), the surface roughness (Ra) of the heat-sensitive recording material before image forming is at most 1.0 $\mu$m or less.

(c) In the heat-sensitive recording material of (a) or (b), wherein a glossiness of the image-formed surface after image forming is at least 40% in terms of glossiness as defined in JIS Z-8741 (20 degrees).

(d) In a heat-sensitive recording material including a heat-sensitive recording layer and a protective layer provided on a substrate, the protective layer includes at least a long-chain alkyl ether-denatured polyvinyl alcohol, waxes, and inorganic ultra fine particles having an average primary particle size of at most 0.1 $\mu$m. When the protective layer is formed of components as described above, a heat-sensitive recording material having the above-described characteristic (surface roughness after image forming) of (a) can be provided efficiently. Consequently, a good balance of the above-described gloss and heat-related properties can be attained.

(e) The above-described long-chain alkyl ether-denatured polyvinyl alcohol having the above-described characteristic of (d) is an alkyl ether-denatured polyvinyl alcohol having 8 to 20 carbon atoms.

(f) The above-described long-chain alkyl ether-denatured polyvinyl alcohol is a polymer represented by a general formula (A) as follows:

General formula (A)

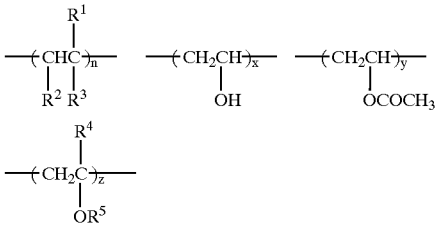

(wherein, $R^1$ represents a hydrogen atom, a methyl group or —$CH_2CO_2M$; $R^2$ represents a hydrogen atom or —$CO_2M$; $R^3$ represents a hydrogen atom, —$CO_2M$, an amino group, an amide group, a substitutional amide group, a hydroxy group, a glycidyl group, a sulfonate group, a polyethylene oxide group, a polypropylene oxide group or a group carrying at least one of above-listed functional groups; $R^4$ represents a hydrogen atom or a methyl group; and $R^5$ represents an alkyl group having 8 to 20 carbon atoms, M represents a hydrogen atom, an alkyl group, an aryl group, an aralkyl group, a sodium atom, a potassium atom or a lithium atom. n, x, y and z each represent a degree of polymerization).

(g) The above-described protective layer is formed by using a least a long-chain alkyl ether-denatured polyvinyl alcohol and other aqueous binder.

DESCRIPTION OF THE PREFERRED EMBODIMENTS

A heat-sensitive recording material of the present invention has a characteristic, as described above, that when image forming is conducted with an application energy of 120 mJ/$m^2$, a surface roughness (Ra) of the image-formed surface of the heat-sensitive recording material after image forming is 0.7 $\mu$m or less. Namely, the present invention is based on the finding that when a surface roughness of a heat-sensitive recording material after image forming has a certain value or less, head properties such as scratch resistance, travelling property, resistance to adherence of residues to a thermal head, and the like can be improved while maintaining gloss.

It is preferable not only to restrict the surface roughness after image forming but also to restrict a surface roughness before image forming to 1.0 $\mu$m or less, because then a material having a surface roughness of 0.7 $\mu$m or less after image forming can be prepared easily. Further, it is preferable that a glossiness of the image-formed surface after image forming is 40% or more in terms of glossiness as defined in JIS Z-8741 (20 degrees).

The surface roughness (Ra) is measured by a three-dimensional non-contact roughness measuring device (Surftest-501, manufactured by Mitsutoyo). Measurement of the surface roughness by the three dimensional non-contact roughness measuring device is conducted according to the following procedure.

(1) Preparation of Sample

A sample is cut to a size of 2 cm×2 cm, and fixed with double-sided tape onto a slide glass such that the surface to be measured faces upward.

(2) Measurement

Conditions of measurement are that a measuring span of 4 mm is selected, and an X-axis of 4096 $\mu$m (pitch 1 $\mu$m), a Y-axis of 10 $\mu$m (pitch 10 $\mu$m) and a measuring range of 30 $\mu$m are selected for sectional curve measurements. Then, measurement is performed.

(3) Data Treatment

After completion of measurement, Ra is selected on a CRT screen. A high pass of 1000 and a low pass of 0 are selected, and an Ra value is calculated.

The heat-sensitive recording material of the present invention manifests excellent properties either in reflective form or in transparent form and, particularly when applied as a transparent heat-sensitive recording material, has excellent transparency and the like.

A heat-sensitive recording material having surface roughness as described above can be efficiently prepared by, for example, forming a protective layer with a layer that includes at least a long-chain alkyl ether-denatured polyvinyl alcohol, a wax, and inorganic ultra fine particles having an average primary particle size of 0.1 $\mu$m or less. The heat-sensitive recording material of this type can attain a good balance of the above-described gloss and head properties.

The long-chain alkyl ether-denatured polyvinyl alcohol used in the present invention is preferably an alkyl ether-denatured polyvinyl alcohol having 8 to 20 carbon atoms, and more preferably a polymer represented by the general formula (A).

In the above-described general formula (A), $R^1$ represents a hydrogen atom, methyl group or —$CH_2CO_2M$; $R^2$ represents a hydrogen atom or —$CO_2M$; $R^3$ represents a hydrogen atom, —$CO_2M$, amino group, amide group, substitution amide group, hydroxy group, glycidyl group, sulfonate group, polyethylene oxide group, polypropylene oxide group or a group carrying at least one of these functional groups; and $R^4$ represents a hydrogen atom or methyl group. Preferable combinations are a combination in which $R^1$, $R^2$ and $R^4$ each represent a hydrogen atom and $R^3$ represents —$CO_2M$, and a combination in which $R^2$ and $R^4$ each represent a hydrogen atom, $R^1$ represents —$CH_2CO_2M$, and $R^3$ represents —$CO_2M$.

M represents a hydrogen atom, alkyl group, aryl group, aralkyl group, a sodium atom, a potassium atom or a lithium atom.

$R^5$ represents a long-chain alkyl group. That is, an alkyl group having 8 to 20 carbon atoms. This alkyl group may be straight or branched, and may have a substituent such as an aryl group and the like. Of such groups, alkyl groups having 8 to 16 carbon atoms are preferable with regard to lubricity, and a dodecyl group having 12 carbon atoms is particularly preferable.

n, x, y and z each represent a degree of polymerization. n is preferably from 0 to 20, and more preferably from 0 to 10. When the value of n is higher, the number of acidic groups increases, providing improved compatibility with gelatin. x is preferably from 60 to 99 and more preferably from 75 to 95, because properties of polyvinyl alcohol such as gas barrier properties and the like can be induced at not more than Tg (a glass transition temperature). y is preferably from 0 to 20. With regard to friction resistance at a heat-sensitive recording head and lubricity, it is preferable that z is higher. However, the value of z as a proportion of the total of n, x, y and z is preferably from 0.5 to 10% and more preferably from 1 to 5%, because the value of z is restricted with respect to solubility and viscosity of an aqueous solution.

Tg of such a long-chain alkyl ether-denatured polyvinyl alcohol is 50 ° C. or more, and preferably 60° C. or more. When Tg (the glass transition temperature) is less than 50° C., the scratch resistance decrease undesirably.

The protective layer in the heat-sensitive recording material of the present invention includes 50% by weight or more of the long-chain alkyl ether-denatured polyvinyl alcohol, and preferably 80% by weight or more. When the long-chain alkyl ether-denatured polyvinyl alcohol content is less than 50% by weight, the above-described properties that depend on the long-chain alkyl ether-denatured polyvinyl alcohol are not manifested sufficiently.

At the surface of the protective layer of the present invention, which uses the long-chain alkyl ether-denatured polyvinyl alcohol, long-chain alkyl groups tend to align. Such a surface reduces dynamic friction at a heat-sensitive head, prevent image forming faults and improve smoothness (gloss) of a image-formed surface and color density. Further, decreases in static friction and dynamic friction of the surface improve traveling property of a medium at a printer. Further, the long-chain alkyl ether-denatured polyvinyl alcohol manifests properties characteristic of polyvinyl alcohols such as excellent light resistance and film strength, and, because hydrophobic groups are aligned at the surface, improves water resistance.

In the protective layer, in addition to the long-chain alkyl ether-denatured polyvinyl alcohol, other aqueous binder components may also be combined if necessary. Examples of the other aqueous binder components include silicone-denatured polymers, gelatin, methylcellulose, carboxymethylcellulose, hydroxyethylcellulose, starches, agar, κ-carageenan, gum arabic, casein, styrene-maleic anhydride copolymer hydrolysate, ethylene-maleicanhydride copolymerhydrolysate, isobutylene-maleic anhydride copolymer hydrolysate, polyvinyl alcohol, denatured polyvinyl alcohol, poyacrylamide and the like.

Of these aqueous binders, silicone-denatured aqueous polymers and ethylene-denatured polyvinyl alcohol are preferable. Specific examples of silicone-denatured aqueous polymers are described in Japanese Patent Application No. 9-7060. Of these, silicone block-denatured polyvinyl alcohol using polyvinyl alcohol at a backbone polymer is particularly preferable. An ethylene-denatured polyvinyl alcohol will be described later.

Examples of polymers suitable as set-dryable aqueous polymers, there are listed proteins such as gelatin and the like, polysaccharides such as carageenan, agar and the like, and polyvinyl alcohol-based compounds and the like. In the case of a polyvinyl alcohol-based compound, this compound can be used as a set-dryable aqueous polymer when combined with boric acid or a salt of boric acid serving as a gelling agent.

As another aqueous binder, synthetic rubber latex, synthetic resin emulsion and the like can be used. Examples of monomers forming these latex and emulsion polymers include acrylic esters, methacrylic esters, crotonic esters, vinyl esters, meleic diesters, fumaric diesters, itaconic diesters, acrylamides, methacrylamides, vinyl ethers, styrenes, acrylonitriles and the like.

More specific examples of these monomers, being acrylic esters, are methyl acrylate, ethyl acrylate, n-propyl acrylate, isopropyl acrylate, n-butyl acrylate, isobutyl acrylate, tert-butyl acrylate, hexyl acrylate, 2-ethylhexyl acrylate, acetoxyethyl acrylate, phenyl acrylate, 2-methoxy acrylate, 2-ethoxy acrylate, 2-(2-methoxyethoxy)ethyl acrylate and the like.

As waxes in the present invention, polyolefin waxes, ester waxes, amide waxes, fatty acids, natural waxes and the like can be used. of these, carnauba wax is preferable.

Further, it is preferable that the emulsified particle diameters of carnauba wax particles in a protective layer coating solution are from 1 to 10 μm.

In the present invention, inorganic ultra fine particles means inorganic fine particles having an average primary particle size of 0.1 μm or less. Particles are not particularly restricted, providing the average primary particle size is 0.1 μm or less. However, the maximum particle size in a dispersion (a threshold value at the large end of a distribution of diameters of particles in the dispersion) is preferably 0.5 μm or less, and more preferably 0.4 μm or less, and particularly preferably 0.35 μm or less. It is preferable that the frequency of a (agglomerated) particles having a particle size of 0.35 μm or more in the dispersion is 5% or less, preferably 1% or less. It is particularly preferable that the frequency of (agglomerated) particles having a particle size of 0.25 μm or more is 5% or less.

Particle diameters can be measured by well known methods, such as, a COULTER N4 type submicron particle size analyzing apparatus (manufactured by NIKKAKI) and the like.

For the inorganic ultra fine particles used in the present invention, an inorganic ultra fine particles of barium sulfate, zinc oxide, magnesium oxide, lead oxide, zirconium oxide, colloidal silica or alumina are preferable, and barium sulfate, colloidal silica and alumina are more preferable. Of these, barium sulfate is particularly preferable. For the inorganic ultra fine particles, a preferably at least one of a group consisting of barium sulfate, zinc oxide, magnesium oxide, lead oxide, zirconium oxide, colloidal silica and alumina is selected. Colloidal silica, barium sulfate and alumina are particularly preferable.

The above-described inorganic ultra fine particles may be used respectively singly, or in a combination of two or more. Colloidal silica has particularly high activity. Then, when colloidal silica is used as the inorganic ultra fine particles, coating unevenness occurs when multiple layers are applied simultaneously, due to interaction with compounds in other layers, depending on combination, which may cause deterioration in surface smoothness of the resulting heat-sensitive recording material. Therefore, if colloidal silica is used, the colloidal silica is preferably used together with other inorganic ultra fine particles, and a compounding ratio (colloidal silica/other inorganic ultra fine particles) is preferably from 1/9 to 6/4 by weight, and further preferably from 2/8 to 5/5. As such a combination of inorganic ultra fine particles used together, a combination of colloidal silica with barium sulfate is preferable, and colloidal silica and barium sulfate are more preferably used together in a compounding ratio of 2/8 to 5/5.

As examples of the inorganic ultra fine particles having an average particle size of 0.1 μm or less which can be suitably used in the present invention, those shown in Table 1 are commercially available.

TABLE 1

| Fine particle material | Trade name | Manufacturer |
|---|---|---|
| Barium sulfate | BARIFINE BF-21 | Sakai Kagaku Kogyo |
| Barium sulfate | BARIFINE BF-20 | Sakai Kagaku Kogyo |
| Zirconium oxide | NZR-A | Nissan Chemical Industries, Ltd. |
| Zinc oxide | FINEX-75 | Sakai Kagaku Kogyo |
| Titanium oxide | TTO-55 | Ishihara Sangyo |
| Silica | | Nippon Aerosil |

In the present invention, an addition amount of an inorganic ultra fine particle to a protective layer is from 0.01 to 1 g/m$^2$, with a weight ratio respective to weight of binders (including a silicone-denatured polymers) from 1 to 100%, and preferably from 5 to 50%. If the addition amount is less than 0.01 g/m$^2$, the effects of addition of the inorganic ultra fine particles are insufficient. If the addition amount is more than 1 g/m$^2$, glossiness may decrease.

With regard to effectiveness and manufacture, it is preferable, in order to prevent agglomeration of the ultra fine particles and to attain uniform adsorption of the ultra fine particles at resin particle surfaces, that a method used for blending the inorganic ultra fine particles with the coating liquid for forming the protective layer of the present invention is one of a method in which the ultra fine particles are blended with an aqueous dispersion resin, like carboxymethyl cellulose, gelatin or polyvinyl alcohol, to obtain a resin solution; a method in which a colloid dispersion is prepared with various mills and the like before being blended; and the like.

In the protective layer, in addition to the long-chain alkyl ether-denatured polyvinyl alcohol, other aqueous binder components may also be combined if necessary. Examples of other aqueous binders include methylcellulose, carboxymethylcellulose, hydroxyethylcellulose, starches, agar, κ-carageenan, gelatin, gum arabic, casein, styrene-maleic anhydride copolymer hydrolysate, ethylene-maleic anhydride copolymer hydrolysate, isobutylene-maleic anhydride copolymer hydrolysate, polyvinyl alcohol, denatured polyvinyl alcohol, poyacrylamide and the like.

Of these polymers, set-dryable aqueous polymers are suitable for high surface smoothness and excellent gloss on a background and an image-formed surface. A set-dryable aqueous polymer means an aqueous polymer which when heated (for example, around 40° C.) manifests a predetermined viscosity and can be applied as a coating, and when cooled thereafter (for example, 5 to 15° C.) increases in viscosity, stops having liquidity and is gelled.

As the aqueous binder, synthetic rubber latex, synthetic resin emulsion and the like can be used. Examples of monomers forming these latex and emulsion polymers include acrylic esters, methacrylic esters, crotonic esters, vinyl esters, maleic diesters, fumaric diesters, itaconic diesters, acrylamides, methacrylamides, vinyl ethers, styrenes, acrylonitriles and the like.

More specific examples of these monomers include, in the case of acrylic esters, methyl acrylate, ethyl acrylate, n-propyl acrylate, isopropyl acrylate, n-butyl acrylate, isobutyl acrylate, tert-butyl acrylate, hexyl acrylate, 2-ethylhexyl acrylate, acetoxyethyl acrylate, phenyl acrylate, 2-methoxy acrylate, 2-ethoxy acrylate, 2-(2-methoxyethoxy)ethyl acrylate and the like.

Examples of methacrylic esters are methyl methacrylate, ethyl methacrylate, n-propyl methacrylate, n-butyl methacrylate, tert-butyl methacrylate, cyclohexyl methacrylate, 2-hydroxyethyl methacrylate, 2-ethoxyethyl methacrylate and the like.

Examples of the crotonic esters are butyl crotonate, hexyl crotonate and the like. Examples of vinyl esters are vinyl acetate, vinyl propionate, vinyl butyrate, vinyl methoxy acetate, vinyl benzoate and the like.

Examples of maleic diesters are diethyl maleate, dimethyl maleate, dibutyl maleate and the like. Examples of fumaric diesters are diethyl fumarate, dimethyl fumarate, dibutyl fumarate and the like. Examples of the itaconic diesters are diethyl itaconate, dimethyl itaconate, dibutyl itaconate and the like.

Examples of acrylamides are acrylamide, methylacrylamide, ethylacrylamide, propylacrylamide, n-butylacrylamide, tert-butylacrylamide, cyclohexylacrylamide, 2-methoxyethylacrylamide, dimethylacrylamide, diethylacrylamide, phenylacrylamide and the like.

Examples of methacrylamides are methylmethacrylamide, ethylmethacrylamide, n-butylmethacrylamide, tert-butylmethacrylamide, 2-methoxymethacrylamide, dimethylmethacrylamide, diethylmethacrylamide and the like.

Examples of vinyl ethers are methyl vinyl ether, butyl vinyl ether, hexyl vinyl ether, methoxyethyl vinyl ether, dimethylamino vinyl ether and the like. Examples of styrenes are styrene, methylstyrene, dimethylstyrene, trimethylstyrene, ethylstyrene, isopropylstyrene, butylstyrene, chloromethylstyrene, methoxystyrene, butoxystyrene, acetoxystyrene, chlorostyrene, dichlorostyrene, bromostyrene, vinyl methyl benzoic ester, 2-methylstyrene and the like.

A polymer formed of these monomers may be a homopolymer or copolymer. Preferably, binary or ternary copolymers of acrylyic esters, methacrylic esters, styrenes, acrylic acid and methacrylic acid; and copolymers of styrenes and butadiene are used.

Tg (glass transition temperature) of a high polymer forming an aqueous binder is 150° C. or less, is preferably from 0 to 130° C., and is particularly preferably from 40 to 100° C.

Further, it is desirable to combine a cross-link reacting cross-linking agent with the silicone-denatured polymer and/or aqueous binder. It is desirable for the silicone-denatured polymer and/or aqueous binder to have functional groups, with at least one functional group selected from: a carboxyl group, an amino group, an ammonium salt group, a hydroxy group, a sulfinic acid group (or salt thereof), a sulfonic acid group (or salt thereof), or a glycidyl group.

Examples that can be used as the above-described cross-linking agent are vinylsulfone-based compounds, aldehyde-based compounds (formaldehyde, glutaraldehyde and the like), epoxy-based compounds, oxazine-based compounds, triazine-based compounds, polymer hardening agents as described in Japanese Patent Application Laid-Open (JP-A) No. 62-234157, methylated melamine, blocked isocyanate, methylol compounds, carbodiimide resin and the like.

Of these cross-linking agents, vinylsulfone-based compounds, aldehyde-based compounds, epoxy-based compounds, oxazine-based compounds, triazine-based compounds and polymer hardening agents described in JP-A No. 62-234157 are suitable.

Further, among denatured-polyvinyl alcohols, silanol-denatured polyvinyl alcohol is particularly preferable. Water resistance and the like can be improved by this alcohol itself. To further improve water resistance, it is effective to use a cross-linking agent and a catalyst, which accelerates the reaction, with the silanol-denatured polyvinyl alcohol.

Specific cross-linking agents are described below.

As an epoxy compound, a di- or more-functional compound can be used, and examples thereof include dibromophenyl glycidyl ether, dibromoneopentyl glycol diglycidyl ether, an emulsion of an epoxycresol novolak resin, denatured-bisphenol A-type epoxy emulsion, adipic diglycidyl ester, diglycidyl o-phthalic ester, hydroquinone diglycidyl ether, bisphenol S glycidyl ether, diglycidyl terephthalic ether, glycidylphthalimide, propylene polypropylene glycol diglycidyl ether, polytetramethylene glycol diglycidyl ether, allyl glycidyl ether, 2-ethylhexyl glycidyl ether, phenyl glycidyl ether, phenol $(EO)_5$ glycidyl ether, p-tertiary butylphenyl glycidyl ether, lauryl alcohol $(EO)_{15}$ glycidyl ether, glycidyl ethers of a mixture of alcohols having 12 to 13 carbon atoms, glycerol polyglycidyl ether, trimethylolpropane polyglycidyl ether, resorcin diglycidyl ether, neopentyl glycol diglycidyl ether, 1,6-hexane diol diglycidyl ether, ethylene polyethylene glycol diglycidyl ether, sorbitol polyglycidyl ether, sorbitan polyglycidyl ether, polyglycerol polyglycidyl ether, pentaerythritol polyglycidyl ether, diglycerol polyglycidyl ether, triglycidyl-tris (2-hydroxyethyl) isocyanurate and the like. Of these epoxy compounds, glycidyl ethers are particularly suitable.

It is desirable that the epoxy equivalent of the epoxy compound effective in the present invention is from 70 to 1000 WPE. If the epoxy equivalent is over 1000 WPE, impartation of water resistance becomes unfavorably difficult.

A blocked isocyanate means a compound in which an end isocyanate group of an isocyanate is masked with a blocking agent. Examples of blocked isocyanates include (a) compounds in which a block body, which is a hydrophilic group formed of a carbamoylsulfonate group (—$NHCOSO_3^-$), is formed on the end of an isocyanate compound to block an active isocyanate group, (b) compounds in which an active isocyanate group is blocked using isopropylidene malonate (this blocked isocyanate is obtained by reaction of HDI isocyanurate, isopropylidene malonate and triethylamine), (c) compounds in which an active isocyanate group is blocked with a phenol, and the like.

Such a blocked is ocyanate is mixed with silanol-denatured polyvinyl alcohol and heated to cross-link and modify the silanol-denatured polyvinyl alcohol, in order to render the silanol-denatured polyvinyl alcohol water-resistant.

Further, vinylsulfone compounds, those described in JP-A Nos. 53-57257 and 53-41221, Japanese Patent Application Publications (JP-B) Nos. 49-13563 and 47-24259 and the like can be used.

Examples of aldehyde-based compounds include monoaldehydes such as formaldehyde, acetaldehyde and the like; polyvalent-aldehydes such as glyoxal, glutaraldehyde, dialdehyde starch and the like; and the like. Examples of methylol compounds include methylolmelamine, dimethylol urea and the like. In the case of the silanol-denatured polyvinyl alcohol, aldehyde-based compounds are particularly suitable as the cross-linking agent.

Desirably, an amount of the cross-linking agent relative to the above-described water-soluble polymer (polymer latex or polymer emulsion) is from 1 to 50 parts by weight of the cross-linking agent mixed with 100 parts by weight of the water-soluble polymer (polymer latex or polymer emulsion). If the amount of the cross-linking agent is less than 1 part by weight, the extent of cross-linking modification is low and water resistance, chemical resistance and the like are insufficient. On the other hand, if the amount is over 50 parts by weight, liquid stability decreases undesirably.

In the protective layer coating liquid of the present invention, in addition to the long-chain alkyl ether-denatured polyvinyl alcohol, the wax and the inorganic ultra fine particles, other aqueous binders, cross-linking agents, catalysts, releasing agents, surfactants, waxes, water repellent agents and the like can be further added if necessary. The resulting protective layer coating liquid is coated onto a heat-sensitive recording layer using a device such as a bar coater, air knife coater, blade coater, curtain coater and the like, and is dried to obtain the protective layer of the present invention. The protective layer may be coated at the same time as the recording layer. Alternatively, the heat-sensitive recording layer may be coated and dried for some time before coating of the protective layer thereon. The coating amount of the protective layer, after drying, is preferably from 0.1 to 3 $g/m^2$, and more preferably from 0.3 to 2.0 $g/m^2$. If the coating amount is large, heat-sensitivity will decrease considerably. If the coating amount is too small, the protective layer cannot perform its functions (friction resistance, lubricity, scratch resistance and the like). Further, after coating of the protective layer, calendering may be conducted if necessary.

[Heat-sensitive Recording Layer]

The heat-sensitive recording layers forming the heat-sensitive recording material of the present invention will be described in detail below.

The heat-sensitive recording material of the present invention may be provided with one heat-sensitive recording layer or a plurality of heat-sensitive recording layers. When a plurality of layers are provided, it is necessary to use color image forming agents that require different energies for color development. The heat-sensitive recording material of the present invention may be a full color material or a monochrome material. It is desirable that the material has, on a substrate, at least one heat-sensitive recording layer (light fixing-type heat-sensitive recording layer), which layer is mainly composed of a binder and a diazo-based color image forming agent, which agent includes containing a diazonium salt compound and a coupler that coupling-reacts with the diazonium salt compound. Further, the color image forming agent in the heat-sensitive recording layer may be, rather than the above-described diazo-based color image forming agent, any of a leuco-based color image forming agent containing an electron donative dye and an electron receptive compound, a basic color image forming agents that develops color by contact with a basic compound, a chelate color image forming agent, a color image forming agent that causes a desorption reaction to develop color by reaction with a nucleophile, and the like.

Preferable examples of light fixing-type heat-sensitive recording layers included in the heat-sensitive recording layer are a heat-sensitive recording layer containing a diazonium salt compound having a maximum absorption wavelength of 360±20 nm and a coupler which reacts with this diazonium salt compound to form color, and a light fixing heat-sensitive recording layer containing a diazonium salt compound having a maximum absorption wavelength of 400±20 nm and a coupler which reacts with this diazonium salt compound to form color.

In the case of a full color heat-sensitive recording layer containing cyan, yellow and magenta layers, all three layers may be formed from diazo-based color image forming agents. Alternatively, a first heat-sensitive recording layer, a layer near the substrate, may be formed from a leuco-based color image forming agent containing an electron donative dye and an electron receptive compound with the second and third heat-sensitive recording layers being formed from diazo-based color image forming agents. However, in the case of full color, it is desirable that cyan, yellow and magenta heat-sensitive recording layers are all formed from diazo-based compounds.

When all three layers are formed of diazo-based color image forming agents, a preferable example is provided with a first light fixing-type heat-sensitive recording layer supported on the substrate, which layer contains a diazonium salt compound having a maximum absorption wavelength of 340±20 nm and a coupler which reacts with this diazonium salt compound to form color, a second light fixing-type heat-sensitive recording layer, which contains a diazonium salt compound having a maximum absorption wavelength of 360±20 nm and a coupler which reacts with this diazonium salt compound to form color, and a third light fixing-type heat-sensitive recording layer which contains a diazonium salt compound having a maximum absorption wavelength of 400±20 nm and a coupler which reacts with this diazonium salt compound to form color. In this embodiment, full color image recording is possible if color image forming hues of respective heat-sensitive recording layers are selected to be the three primary colors of subtractive color mixing, yellow, magenta and cyan.

Further, when a leuco-based color image forming agent is used in the first layer, example of a heat-sensitive recording material is provided with a first heat-sensitive recording layer supported on the substrate, which layer contains an electron donative dye and an electron receptive compound, a second (light fixing-type) heat-sensitive recording layer, which contains a diazonium salt compound having a maximum absorption wavelength of 360±20 nm and a coupler which reacts with this diazonium salt compound to form color, and a third (light fixing-type) heat-sensitive recording layer, which contains a diazonium salt compound having a maximum absorption wavelength of 400±20 nm and a coupler which reacts with this diazonium salt compound to form color.

A heat-sensitive recording material applied on a transparent substrate as a transmission-type heat-sensitive recording layer is a preferable system for manifesting the effects of the present invention.

A heat sensitive recording material that is particularly effective for application of the present invention desirably has, on a substrate, at least, a light fixing-type heat-sensitive recording layer, which contains a diazonium salt compound having a maximum absorption wavelength of 360±20 nm and a coupler which reacts with this diazonium salt compound to form color, and a light fixing-type heat-sensitive recording layer, which contains a diazonium salt compound having a maximum absorption wavelength of 400±20 nm and a coupler which reacts with this diazonium salt compound to form color, and is provided with a light transmittance controlling layer on the light fixing-type heat-sensitive recording layers. In the case of such a heat-sensitive recording material, it is desirable that light transmittance in the light-fixing wavelength range of the light transmittance controlling layer is fixed by a light is 65% or more at 360 nm and that the light transmittance after fixing is 20% or less at 360 nm. In this case, light irradiation means light irradiation of 13 kJ/$m^2$ at a wavelength of 420 nm by a xenon lamp forced test device. Specifically, it means light irradiation at 0.9 W/$m^2$ by a Weather-Ometer Ci65 (manufactured by Atlas Electric Co.) for 4.0 hours.

Further, the present invention may be applied in a case in which the heat-sensitive recording material has a light fixing-type heat sensitive recording layer containing a diazonium salt compound having a maximum absorption wavelength of less than 340 nm and a coupler that reacts with this diazonium salt compound to form color, and a light fixing-type heat-sensitive recording layer containing a diazonium salt compound having a maximum absorption wavelength of more than 420 nm and a coupler which reacts with this diazonium salt compound to form color.

For the various heat-sensitive recording materials listed above, particularly the full color heat-sensitive recording materials, it is desirable to provide the below-described light transmittance controlling layer and the above-described protective layer on a heat-sensitive recording layer.

For recording using the above-described heat-sensitive recording material including a plurality of diazo based color image forming agent-containing heat-sensitive recording layers, the third heat-sensitive recording layer is heated to color-develop a diazonium salt compound and coupler included in the layer. Then, un-reacted diazonium salt compound in the third heat-sensitive recording layer is decomposed by irradiation with light having the maximum absorption wavelength of the diazonium salt compound. Then, sufficient heat for color development is applied to the second heat-sensitive recording layer, and allow a diazonium salt compound and a coupler contained in the layer to develop color. At this time, although the third heat-sensitive recording layer is heated strongly simultaneously, the third layer does not develop color because the diazonium salt compound therein has already been decomposed and color image forming ability thereof has been lost. Further, the diazonium salt compound in the second heat-sensitive recording layer is decomposed and fixed by irradiation with light having the maximum absorption wavelength of the diazonium salt compound. Finally, sufficient heat for color development is applied to the first heat-sensitive recording layer. At this time, although the third and second heat-sensitive recording layers are strongly heated simultaneously, the second and third layers do not develop color because the diazonium salt compounds therein have already been decomposed and color image forming ability thereof has been lost. Fixing treatment of diazonium salt compound in the first layer can be omitted. Further, when the first layer has a leuco-based color image forming agent, the other two heat-sensitive recording layers, which contain a diazonium-based color image forming agents, are color-developed in the same manner as described above and finally, the layer containing the leuco-based color image forming agent is heated to develop color.

In the present invention, conventionally known color developing components can be applied as color image forming components that are used in the heat-sensitive recording layers. Particularly, color developing components that utilize a reaction of a diazonium salt compound with a coupler or that utilize a reaction of an electron donative colorless dye with an electron receptive compound are preferable. As compounds that can be used in a heat-sensitive recording layer containing a diazonium salt compound and the coupler (the coupler reacts with the diazonium salt compound and develops color when heated), in addition to a diazonium salt compound and a coupler which reacts with this diazonium salt compound to form pigment, basic substances and the like which accelerate reaction of the diazonium salt compound with the coupler are included. The diazonium salt compound is a compound as shown below, and the maximum absorption wavelength of the compound can be controlled by the position and kind of substituents of the Ar portion.

$$Ar—N_2^+ \blacksquare X^-$$

Wherein Ar represents an aryl group and $X^-$ represents an acid anion.

Specific examples of the diazonium salt compound in the present invention include acid anion salts such as 4-(N-(2-(2,4-di-tert-amylphenoxy)butyryl)piperazino)benzene diazonium, 4-dioctylaminobenzene diazonium, 4-(N-(2-ethylhexanoyl)piperazino)benzene diazonium, 4-dihexylamino-2-hexyloxybenzene diazonium, 4-N-ethyl-N-hexadecylamino-2-ethoxybenzo diazonium, 3-chloro-4-dioctylamino-2-octyloxybenzene diazonium, 2,5-dibutoxy-4-morpholinobenzene diazonium, 2,5-octoxy-4-morpholinobenzene diazonium, 2,5-dibutoxy-4-(N-(2-ethylhexanoyl)piperazino)benzene diazonium, 2,5-diethoxy-4-(N-(2-(2,4-di-tert-amylphenoxy)butyryl)piperazino)benzene diazonium, 2,5-dibutoxy-4-tolylthiobenzene diazonium, 3-(2-octyloxyethoxy)-4-morpholinobenzene diazonium and the like, and the following diazonium salt compounds D-1 to D-5. The diazonium salt compound is particularly preferably a hexafluorophosphate salt, tetrafluoroborate salt or 1,5-naphthalene sulfonate salt.

D-1

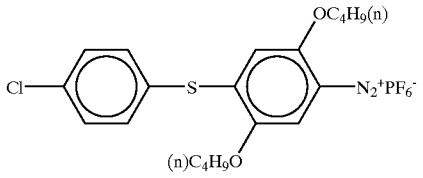

D-2

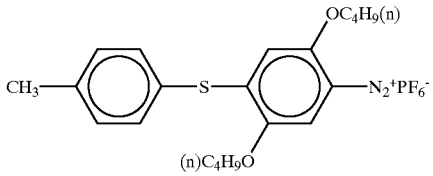

D-3

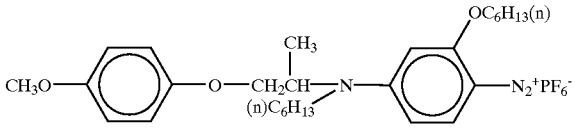

D-4

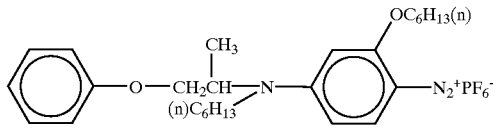

D-5

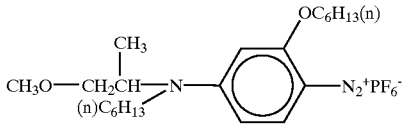

Of these diazonium salt compounds, particularly preferable in the present invention are 4-(N-(2-(2,4-di-tert-amylphenoxy)butyryl)piperazino)benzene diazonium, 4-dioctylaminobenzene diazonium, 4-(N-(2-ethylhexanoyl) piperazino)benzene diazonium, 4-dihexylamino-2-hexyloxybenzene diazonium, 4-N-ethyl-N-hexadecylamino-2-ethoxybenzo diazonium, 2,5-dibutoxy-4-(N-(2-ethylhexanoyl)piperazino)benzene diazonium and 2,5-diethoxy-4-(N-(2-(2,4-di-tert-amylphenoxy)butyryl) piperazino)benzene diazonium, which are photodecomposed by light having a wavelength of 300 to 400 nm, and compounds D-3 to D-5 as shown in the above-described specific examples.

The maximum absorption wavelength referred to herein of a diazonium salt compound is a value obtained by measuring a film of the respective compound 0.1 g/m$^2$ to 1.0 g/m$^2$density with a spectrophotometer (Shimadzu MPS-2000).

Examples of the coupler that reacts with the above-described diazonium salt used in the present invention to develop color when heated include resorcin, fluoroglucin, sodium 2,3-dihydroxynaphthalene-6-sulfonate, morpholinopropyl 1-hydroxy-2-naphthoic amide, 1,5-dihydroxynaphthalene, 2,3-dihydroxynaphthalene, 2,3-dihydroxy-6-sulfanylnaphthalene, 2-hydroxy-3-naphtoic anilide, 2-hydroxy-3-naphthoic ethanolamide, octyl 2-hydroxy-3-naphthoic amide, N-dodecyloxypropyl 2-hydroxy-3-naphtoate amide, tetradecyl 2-hydroxy-3-naphthoic amide, acetoanilide, acetoacetoanilide, benzoylacetoanilide, 2-chloro-5-octylacetoacetoanilide, 1-phenyl-3-methyl-5-pyrazolone, 1-(2'-octylphenyl)-3-methyl-5-pyrazolone, 1-(2',4',6'-trichlorophenyl)-3-benzamide-5-pyrazolone, 1-(2',4',6'-trichlorophenyl)-3-anilino-5-pyrazolone, 1-phenyl-3-phenylacetoamide-5-pyrazolone, compounds C-1 to C-6 described below and the like. These couplers can also be used in combinations of two or more to obtain intended color image forming hues.

C-1

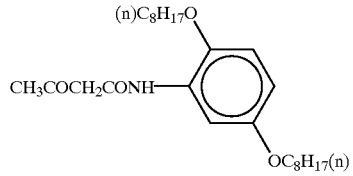

C-2

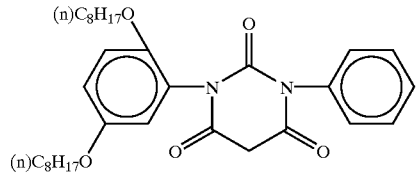

C-3

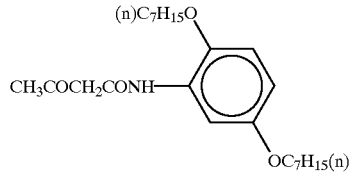

C-4

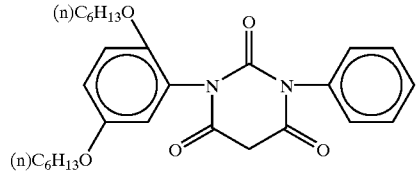

C-5

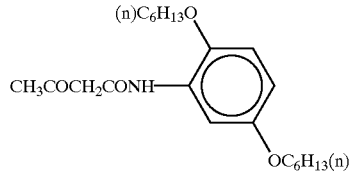

C-6

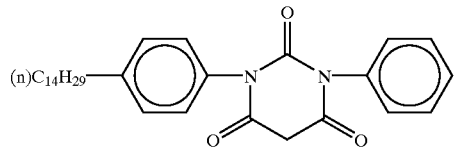

In addition to inorganic or organic basic compounds, the basic substances include compounds that manifest decomposition and the like and release alkaline substances when heated. Typical examples thereof include nitrogen-containing compounds such as organic ammonium salts, organic amines, amides, urea and thiourea and derivatives thereof, thiazoles, pyrroles, pyrimidines, piperazines, guanidines, indoles, imidazoles, imidazolines, triazoles, morpholines, piperidines, amidines, formazines, piridines and the like. Specific examples thereof include tricyclohexylamine, tribenzylamine, octadecylbenzylamine, stearylamine, allylurea, thiourea, methylthiourea, allylthiourea, ethylenethiourea, 2-benzylimidazole, 4-phenylimidazole, 2-phenyl-4-methylimidazole,2-undecylimidazoline, 2,4,5-trifuryl-2-imidazoline, 1,2-diphenyl-4,4-dimethyl-2-imidazoline, 2-phenyl-2-imidazoline, 1,2,3-triphenylguanidine, 1,2-dicyclohexylguanidine, 1,2,3-tricyclohexylguanidine, guanidine trichloroacetate, N,N'-dibenzylpiperazine, 4,4'-dithiomorpholine, morpholinium trichloroacetate, 2-aminobenzothiazole, 2-benzoylhydrazinobenzothiazole and the like. These may be used in combinations of two or more.

Examples of the electron donative dye precursor that can be used in the present invention include triarylmethane-based compounds, diphenylmethane-based compounds, thiazine-based compounds, xanthene-based compounds, spiropyrane-based compounds and the like. In particular, triarylmethane-based compounds and xanthene-based compounds have high color development concentration and are useful. Some examples thereof are 3,3-bis(p-dimethylaminophenyl)-6-dimethylaminophthalide (namely, crystal violet lactone), 3,3-bis(p-dimethylamino)phthalide, 3-(p-dimethylaminophenyl)-3-(1,3-dimethylindole-3-yl) phthalide, 3-(p-dimethylaminophenyl)-3-(2-methylindole-3-yl)phthalide, 3-(o-methyl-p-diethylaminophenyl)-3-(2-methylindole-3-yl)phthalide, 4,4'-bis(dimethylamino) benzhydrine benzyl ether, N-halophenylleucoauramine, N-2,4,5-trichlorophenylleucoauramine, rhodamine-B-anilinolactam, rhodamine(p-nitroanilino)lactam, rhodamine-B-(p-chloroanilino)lactam, 2-benzylamino-6-diethylaminofluorane, 2-anilino-6-diethylaminofluorane, 2-anilino-3-methyl-6-diethylaminofluorane, 2-anilino-3-methyl-6-cyclohexylmethylaminofluorane, 2-anilino-3-methyl-6-isoamylethylaminofluorane, 2-(o-chloroanilino)-6-diethylaminofluorane, 2-octylamino-6-diethylaminofluorane, 2-ethoxyethylamino-3-chloro-2-diethylaminofluorane, 2-anilino-3-chloro-6-diethylaminofluorane, benzoylleucomethylene blue, p-nitrobenzylleucomethylene blue, 3-methyl-spiro-dinaphthopyrane, 3-ethyl-spiro-dinaphthopyrane, 3,3'-dichloro-spiro-dinaphthopyrane, 3-benzylspirodinaphthopyrane, 3-propyl-spiro-dibenzopyrane and the like.

Examples of the electron receptive compound include phenol derivatives, salicylic acid derivatives, hydroxybenzoic esters and the like. Bisphenols and hydroxybenzoic esters are particularly preferable. Some examplesthereof are 2,2-bis (p-hydroxyphenyl)propane (namely, bisphenol A), 4,4'-(p-phenylenediisopropylidene)diphenol (namely, bisphenol P), 2,2-bis(p-hydroxyphenyl)pentane, 2,2-bis(p-hydroxyphenyl)ethane, 2,2-bis(p-hydroxyphenyl)butane, 2,2-bis(4'-hydroxy-3',5'-dichlorophenyl)propane, 1,1-(p-hydroxyphenyl)cyclohexane, 1,1-(p-hydrophenyl)propane, 1-1,1-(p-hydroxyphenyl)pentane, 1,1-(p-hydroxyphenyl)-2-ethylhexane, 3,5-di(α-methylbenzyl)salicylic acid and polyvalent metal salts thereof, 3,5-di(tert-butyl)salicylic acid and polyvalent metal salts thereof, 3-α, α-dimethylbenzylsalicylic acid and polyvalent metal salts thereof, butyl p-hydrobenzoic acid, benzyl p-hydroxybenzoic acid, 2-ethylhexyl p-hydroxybenzoic acid, p-phenylphenol, p-cumylphenol and the like.

As the sensitizer, low melting point organic compounds having moderate numbers of aromatic groups and polar groups in the molecules thereof are preferable. Examples thereof include α-naphthyl benzyl ether, β-naphthyl benzyl ether, phenyl β-naphthoic ester, phenyl α-hydroxy-β-naphthoic ester, β-naphthol (p-chlorobenzyl) ether, 1,4-butanediol phenyl ether, 1,4-butanediol p-methylphenyl ether, 1,4-butanediol p-ethylphenyl ether, 1,4-butanediol m-methylphenyl ether, 1-phenoxy-2-(p-tolyloxy)ethane, 1-phenoxy-2-(p-ethylphenoxy)ethane, 1-phenoxy-2-(p-chlorophenoxy)ethane, p-benzylbiphenyl and the like.

In the present invention, usage embodiments of the above-described diazonium salt compound, coupler which reacts with the diazonium salt compound and forms color, basic substance, and the electron donative colorless dye, electron receptive compound and sensitizer are not particularly restricted. That is, (1) amethodof solid-dispersion foruse, (2) a method of emulsion-dispersion for use, (3) a method of polymer-dispersion for use, (4) a method of latex-dispersion for use, (5) a method of microcapsulation for use, and the like are available. of these methods, the method of microcapsulation for use is preferable, particularly with regard to storability. Particularly, in a color image forming system utilizing a reaction of a diazonium salt compound with a coupler, microcapsulation of the diazonium salt compound is preferable, and in a color image forming system utilizing a reaction of an electron donative colorless dye with an electron receptive compound, microcapsulation of the electron donative colorless dye is preferable.

For microcapsulation, conventionally known microcapsulation methods can be used. That is, a microcapsule can be prepared as follows: a coloring agent, additives and microcapsule wall precursor are dissolved in an organic solvent which is poorly soluble or insoluble in water. The resulting solution is added to an aqueous solution of a water-soluble high polymer, emulsion-dispersed using a homogenizer or the like and heated. The high polymer substance forms a microcapsule wall as a wall film at an oil/water interface.

Examples of the above-described organic solvent include low boiling point auxiliary solvents such as acetates, methylene chloride, cyclohexanone and the like, and/or phosphates, phthalic ester, acrylic esters, methacrylic esters, other carboxylic esters, fatty amides, alkylated biphenyl, alkylated terphenyl, alkylated naphthalene, diarylethane, paraffin chloride, alcohols, phenols, ethers, monoolefins, epoxys, and the like. Specific examples include high boiling point oils such as tricresyl phosphate, trioctyl phosphate, octyldiphenyl phosphate, tricyclohexyl phosphate, dibutyl phthalate, dioctyl phthalate, phthalic dilaurate, dicyclohexyl phthalate, oleifinic butyl, diethylene glycol benzoate, dioctyl sebacate, dibutyl sebacate, dioctyl adipate, trioctyl trimellitate, acetyltriethyl citrate, octyl maleate, dibutyl maleate, isoamylbiphenyl, paraffin chloride, diisopropylnaphthalene, 1,1'-ditolylethane, 2,4-di-tert-amylphenol, N,N-dibutyl-2-butoxy-5-tert-octylaniline, 2-ethylhexyl hydroxybenzoic ester, polyethylene glycol and the like. Of these, alcohols, phosphoric esters, carboxylic esters, alkylated biphenyl, alkylated terphenyl, alkylated naphthalene and diarylethane are particulary preferable. Further, carbonization-preventing agents such as hindered phenol, hindered amine and the like may be added to the above-described high boiling point oils. Further, of the oils, those containing unsaturated fatty acids are particularly desirable. Examples are α-methylstyrene dimers and the like. Examples of α-methylstyrene dimers are MSD 100, manufactured by Mitsui Toatsu Chemicals, Inc., and the like.

As the water-soluble high polymer, water-soluble high polymers such as polyvinyl alcohol and the like are used. An emulsion, latex or the like of a hydrophobic high polymer can be combined with the water-soluble high polymer. Examples of the water-soluble high polymer include polyvinyl alcohol, silanol-denatured polyvinyl alcohol, carboxy-denatured polyvinyl alcohol, amino-denatured polyvinyl alcohol, itaconic acid-denatured polyvinyl alcohol, styrene-maleic anhydride copolymer, butadiene-maleic anhydride copolymer, ethylene-maleic anhydride copolymer, isobutylene-maleic anhydride copolymer, polyacrylamide, polystyrenesulfonic acid, polyvinylpyrrolidone, ethylene-acrylic acid copolymer, gelatin and the like. Of these, carboxyl-denatured polyvinyl alcohol is particularly preferable. Examples of the emulsion or latex of a hydrophobic polymer include a styrene-butadiene copolymer, carboxy-modified styrene-butadiene copolymer, acrylonitrile-butadiene copolymer and the like. In this procedure, conventionally known surfactants and the like may be added if necessary.

Specific examples of the high polymer substance which forms the wall films of the microcapsules include polyurethane resins, polyurea resins, polyamide resins, polyester resins, polycarbonate resins, aminoaldehyde resins, melamine resins, polystyrene resins, styrene-acrylate copolymer resins, styrene-methacrylate copolymer resins, gelatin, polyvinyl alcohol and the like. Of these, polyurethane resins and polyurea resins are particularly preferable as wall materials.

A microcapsule having a wall film composed of polyurethane resin or polyurea resin is produced by mixing a microcapsule wall precursor such as a polyvalent isocyanate and the like into a core substance to be capsulated, emulsion-dispersing the resulting mixture in an aqueous solution of a water-soluble high polymer such as polyvinyl alcohol and the like, and causing a high polymer-forming reaction at surfaces of oil drops by increasing the temperature of the solution.

Some specific examples of the polyvalent isocyanate compound are shown below. The examples are diisocyanates such as m-phenylene diisocyanate, p-phenylene diisocyanate, 2,6-tolylene diisocyanate, 2,4-tolylene diisocyanate, naphthalene-1,4-diisocyanate, diphenylmethane-4,4'-diisocyanate, 3,3'-diphenylmethane-4,4'-diisocyanate, xylene-1,4-diisocyanate, 4,4'-diphenylpropane diisocyanate, tolymethylene diisocyanate, hexamethylene diisocyanate, propylene-1,2-diisocyanate, butylene-1,2-diisocyanate, cyclohexylene-1,2-diisocyanate, cyclohexylene-1,4-diisocyanate and the like; triisocyanates such as 4,4',4"-triphenylmethane triisocyanate, toluene-2,4,6-triisocyanate and the like; tetraisocyanates such as 4,4'-dimethylphenylmethane-2,2',5,5'-tetraisocyanate and the like; and isocyanate prepolymers such as adduct of hexamethylene diisocyanate with trimethylolpropane, adduct of 2,4-tolylene diisocyanate with trimethylolpropane, adduct of xylylene diisocyanate with trimethylolpropane, adduct of tolylene diisocyanate with hexane triol, and the like. If necessary, two or more of these compounds can be used together. Of these compounds, those having three or more isocyanate groups in the molecule are particularly preferable.

In the microcapsulation process, the oils shown for the emulsion-dispersion can be used as the organic solvent for dissolving the coloring agent, additives and microcapsule wall precursor. Water-soluble polymers may be used in a similar manner.

The particle diameters of the microcapsules are preferably from 0.1 to 1.0 μm, and further preferably from 0.2 to 0.7 μm.

[Light Transmittance Controlling Layer]

The light transmittance controlling layer contains a component that functions as a precursor of an ultraviolet absorber and that does not function as the ultraviolet absorber before irradiation with light having a wavelength in the range necessary for fixing. Therefore, light transmittance is high, and when a light fixing-type heat-sensitive recording layer is fixed, wavelengths in the range necessary for fixing are sufficiently transmitted. Further, the transmittance of visible light is high. Thus, no problems are caused fixing of the heat-sensitive recording layer. This precursor of the ultraviolet absorber is preferably contained in a microcapsule. In the present invention, as the compound contained in the light transmittance controlling layer, a compound described in JP-A No. 9-1928 can be used.

After termination of irradiation by the light having a wavelength in the range necessary for fixing of the light fixing-type heat-sensitive recording layer by light irradiation, a reaction caused by light, heat or the like causes the precursor of the ultraviolet absorber to begin functioning as the ultraviolet absorber. Most light having a wavelength in a range necessary for fixing of the ultraviolet range is absorbed by the ultraviolet absorber. Consequently, the transmittance decreases and the light resistance of the heat-sensitive recording material increases. However, because there is no effect on visible light absorption, transmittance of visible light does not effectively change.

At least one light transmittance controlling layer can be provided in a light fixing-type heat-sensitive recording material. Most desirably, the light transmittance controlling layer may be formed between a light fixing-type heat-sensitive recording layer and an outermost protective layer, and alternatively, may function both as a light transmittance controlling layer as a protective layer. The properties of the light transmittance controlling layer can be freely selected to suit the properties of the light fixing-type heat-sensitive recording layer.

In the present invention, known antioxidants, shown below, can be used for further improving light resistance. Examples are described in EP-A 310551, DE-A 3435443, EP-A 310552, JP-A No. 3-121449, EP-A 459416, JP-A Nos. 2-262654, 2-71262 and 63-163351, U.S. Pat. No. 4,814,262, JP-A Nos. 54-48535, 5-61166 and 5-119449, U.S. Pat. No. 4,980,275, JP-A Nos. 63-113536 and 62-262047, EP-A 223739, 309402 and 309401 and the like. Specific examples are listed below.

Q-1

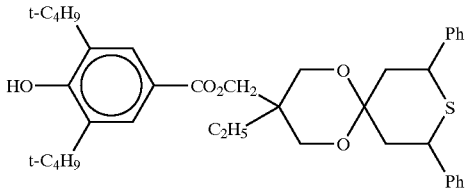

Q-2

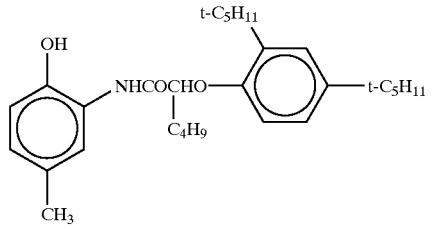

-continued
Q-3
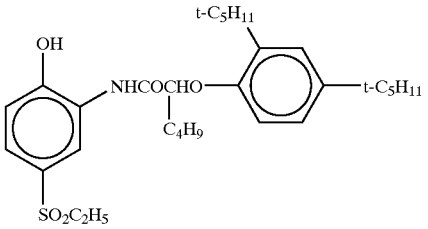
Q-4
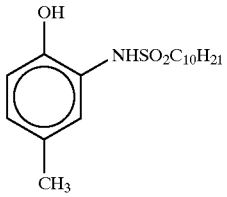
Q-5
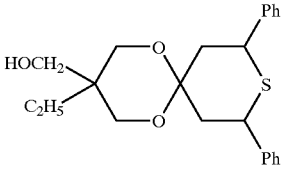
Q-6
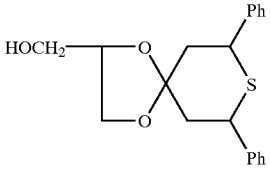
Q-7
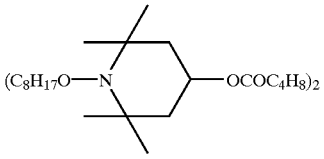
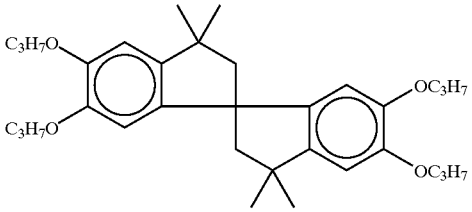
Q-8
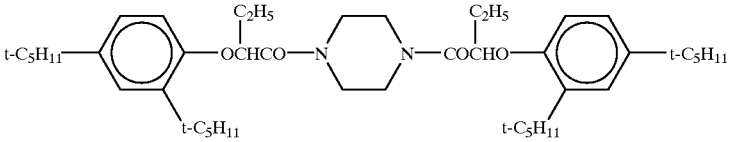
Q-9
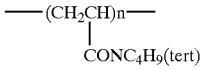
Q-10
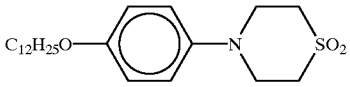
Q-11
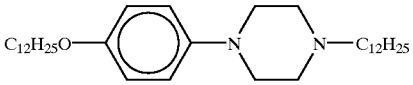
Q-12
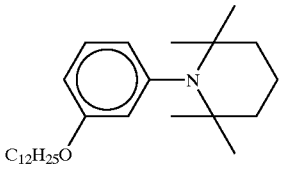
Q-13
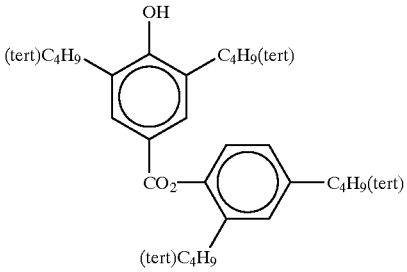
Q-14
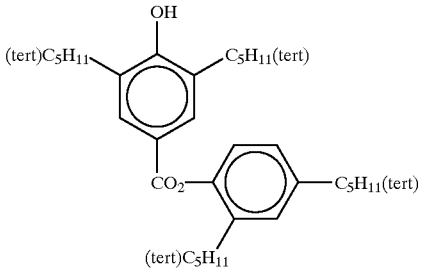
Q-15
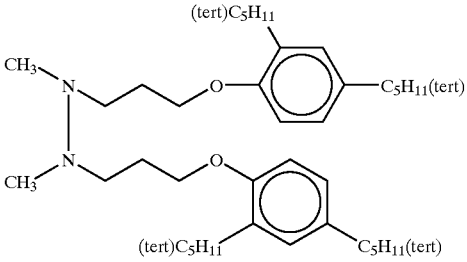
Q-16
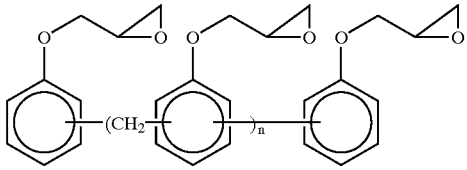

-continued
Q-17
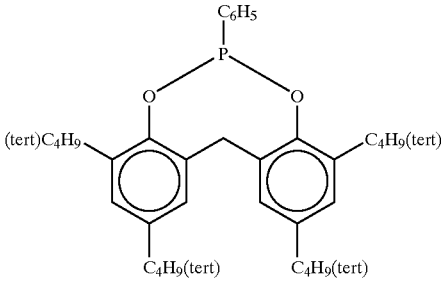
Q-18
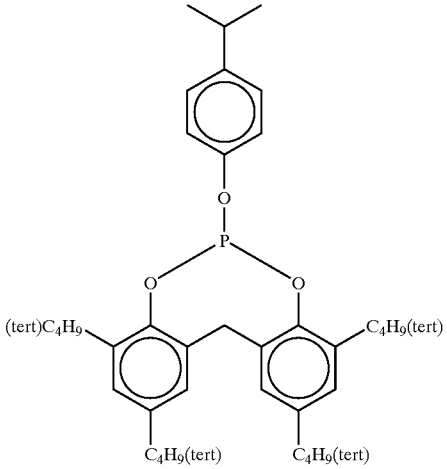
Q-19
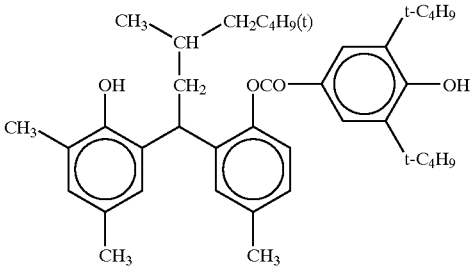
Q-20
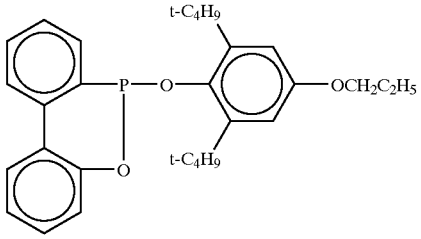
Q-21
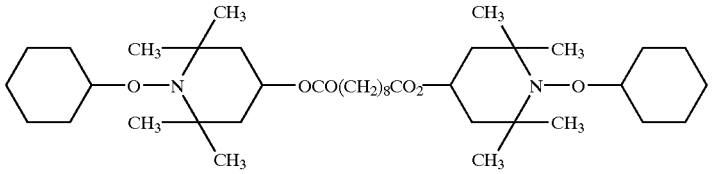
Q-22
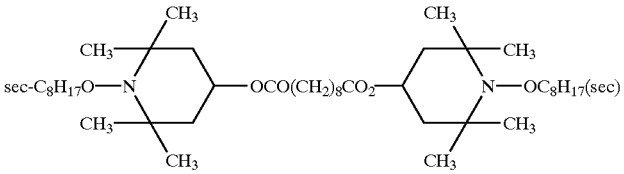
Q-23
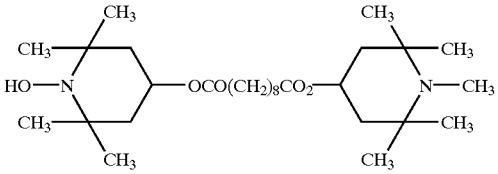
Q-24
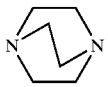
Q-25
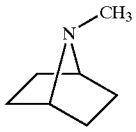
Q-26
$(C_{14}H_{27}OCOCH_2CH_2)_2S$
Q-27
$(C_{18}H_{37}OCOCH_2CH_2)_2S$
Q-28
$(C_{12}H_{25}SCH_2CH_2CO_2CH_2)_4C$
Further, it is also effective to use various additives already known as heat-sensitive recording materials and pressure-sensitive recording material. Of these, some examples of antioxidants include compounds described in JP-A Nos. 60-125470, 60-125471, 60-125472, 60-287485, 60-287486, 60-287487, 62-146680, 60-287488, 62-282885, 63-89877, 63-88380, 63-088381, 01-239282, 04-291685, 04-291684, 05-188687, 05-188686, 05-110490, 05-1108437, 05-170361, 63-203372, 63-224989, 63-267594, 63-182484, 60-107384, 60-107383, 61-160287, 61-185483, 61-211079, 63-251282 and 63-051174; JP-B Nos. 48-043294 and 48-033212; and the like.

Specific examples of such compounds include 6-ethoxy-1-phenyl-2,2,4-trimethyl-1,2-dihydroquinoline, 6-ethoxy-1-octyl-2,2,4-trimethyl-1,2-dihydroquinoline, 6-ethoxy-1-phenyl-2,2,4-trimethyl-1,2,3,4-tetrahydroquinoline, 6-ethoxy-1-octyl-2,2,4-trimethyl-1,2,3,4-tetrahydroquinoline, nickel cyclohexanoate, 2,2-bis-4-hydroxyphenylpropane, 1,1-bis-4-hydroxyphenyl-2-ethylhexane, 2-methyl-4-methoxy-diphenylamine, 1-methyl-2-phenylindole, and compounds shown below.

Q-29

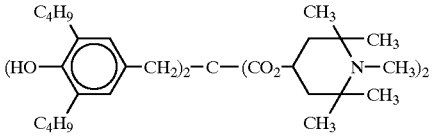

Q-30

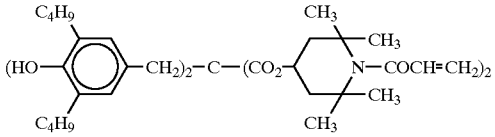

Q-31

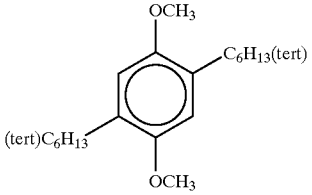

Q-32

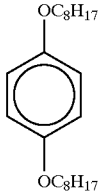

Q-33

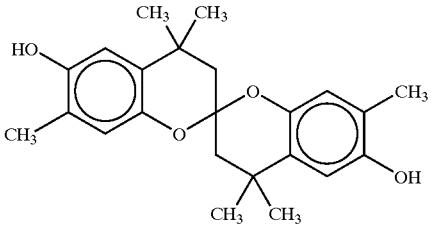

Q-34

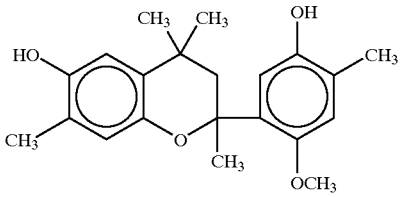

Q-35

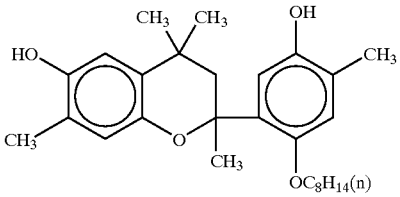

Q-36

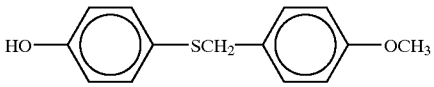

Q-37

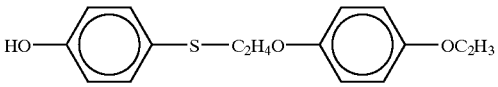

Q-38

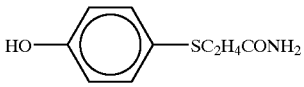

Q-39

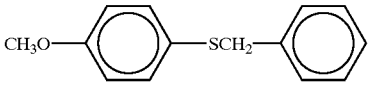

Q-40

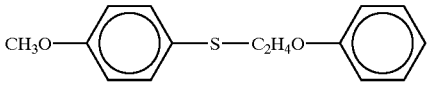

Q-41

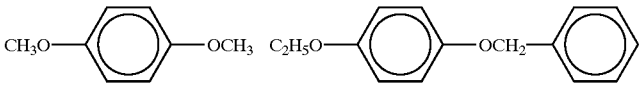

Q-42

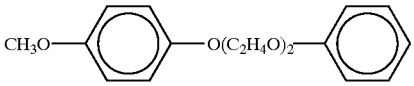

Q-43

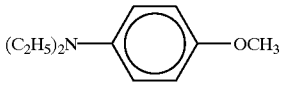

Q-44

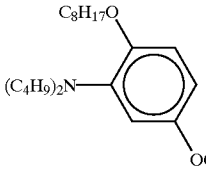

-continued
Combination of
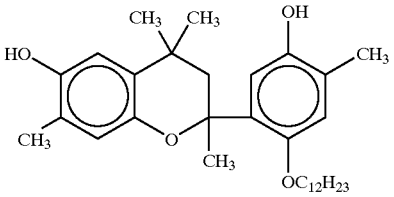
and
Q-45
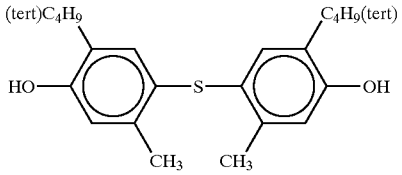
Combination of
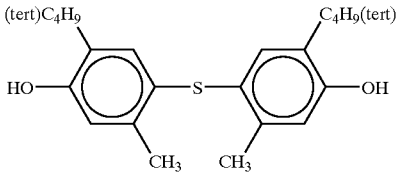
and Hydroquinone ether
Q-46
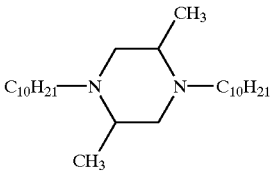
Q-47
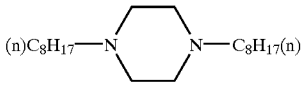
Q-48
Q-49
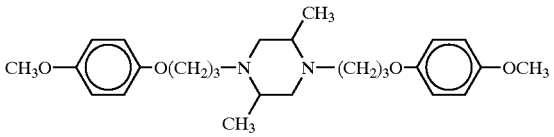
Q-50
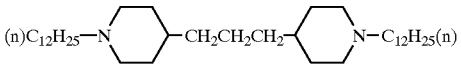
Q-51
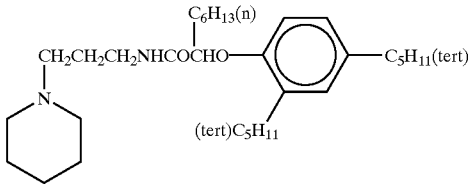
Q-52
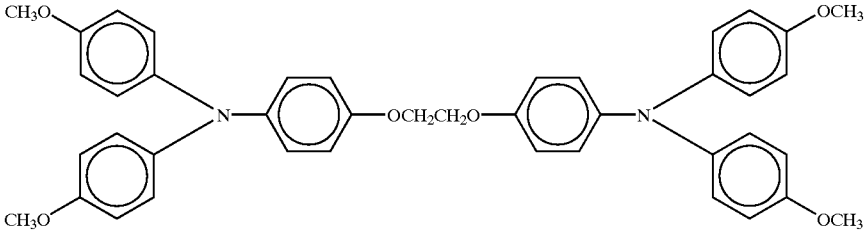
Q-53
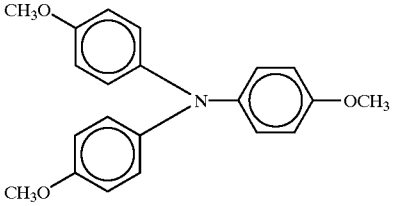
Q-54
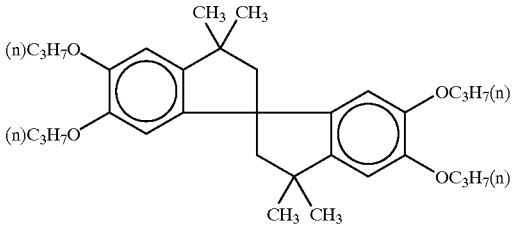
Q-55
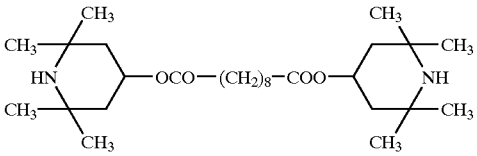
Q-56
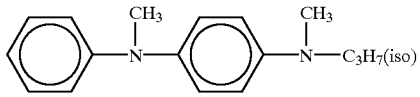

-continued

Q-57

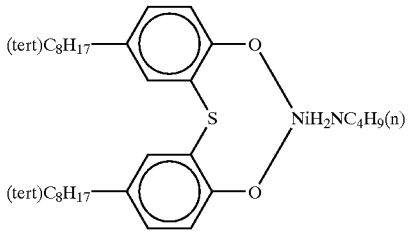

Q-58

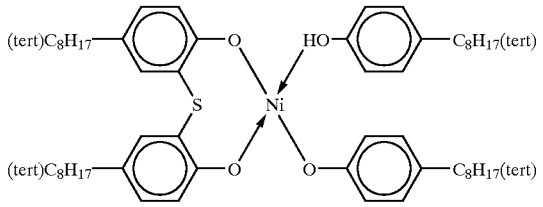

These antioxidants can be added to a heat-sensitive recording layer or an intermediate layer, light transmittance controlling layer or protective layer. When these antioxidants and the like are combined and used, and specific examples of combinations include (Q-7), (Q-45), (Q-46) and compound (Q-10) with compound (Q-13).

As the substrate in the present invention, plastic films, paper, plastic resin laminated paper, synthetic paper and the like can be used.

In the present invention, when heat-sensitive color image forming layers having different hues are laminated, intermediate layers can be provided to prevent color mixing and the like. When substrates having high $O_2$ transmittance such as laminated paper and the like are used, a primer layer can be provided as an $O_2$ cutting layer to improve light resistance. Water-soluble high polymer compounds are used in the intermediate layers and the primer layer. Examples include polyvinyl alcohol, denatured polyvinyl alcohol, methylcellulose, sodium polystyrenesulfonate, sytrene-maleic acid copolymer, gelatin and the like.

It is effective to add swellable inorganic stratified compounds, as described in Japanese Patent Application No. 7-113825, to prevent color mixing and improve light resistance in thinner intermediate layers and a thinner primer layer.

In the above-described examples, specifically full color heat-sensitive recording layers are described. However, the heat-sensitive recording material of the present invention may also be a heat-sensitive recording material having a monochrome heat-sensitive recording layer.

A monochrome heat-sensitive recording layer contains at least a substantially colorless color image forming component A and a substantially colorless color image forming component B, which reacts with the color image forming component A to develop color. The color image forming component A and color image forming component B that are used are components which cause a color image forming reaction when they touch each other. Examples of such combinations include the following combinations (1) to (13) are listed.

(1) Combinations of light decomposing diazo compounds with couplers.

(2) Combinations of electron donative dye precursors with electron receptive compounds.

(3) Combinations of organometal salts such as silver behenate, silver stearate and the like with reducing agents such as protocatechinic acid, spiroindane and hydroquinone.

(4) Combinations of long-chain fatty acid salts such as ferric stearate and ferric myristate with phenols such as tannic acid, gallic acid and ammonium salicylate.

(5) Combinations of heavy metal salts of organic acids, such as nickel, cobalt, lead, copper, iron, mercury and silver salts of acetic acid, stearic acid, palmitic acid and the like, with alkaline earth metal sulfides such as calcium sulfide, strontium sulfide and potassium sulfide, or combinations of the above-described heavy metal salts of organic acids with organic chelating agents such as s-diphenylcarbazide and diphenylcarbazone.

(6) Combinations of heavy metal sulfates such as sulfates of silver, lead, mercury and sodium with sulfur compounds such as sodium-tetrathionate, sodium thiosulfate and thiourea.

(7) Combinations of ferric salts of fatty acids such as ferric stearate with aromatic polyhydroxy compounds such as 3,4-hydroxytetraphenylmethane.

(8) Combinations of organometal salts such as mercury oxalate and oxalates with organic polyhydroxy compounds such as polyhydroxy alcohol, glycerine and glycol.

(9) Combinations of ferric salts of fatty acids such as ferric pelargonate and ferric laurate with thiocecylcarbamide and isothiocecylcarbamide derivatives.

(10) Combinations of organolead salts such as lead caproate, lead pelargonate and lead behenate with thiourea derivatives such as ethylenethiourea and N-dodecylthiourea.

(11) Combinations of higher fatty acid heavy metal salts such as ferric stearate and copper stearate with zinc dialkyldithiocarbamates.

(12) Combinations that form oxazine dyes, such as combinations of resorcin with nitroso compounds.

(13) Combinations of formazane compounds with reducing agents and/or metal salts.

Of these combinations, in the present invention, (1) Combinations of light decomposing diazo compounds with couplers, (2) Combinations of electron donative dye precursors with electron receptive compounds and (3) Combinations of organometal salts with reducing agents are preferable. (1) and (2) are more preferable. (1) is particularly preferable.

EXAMPLES

The following examples illustrate the present invention more specifically but do not limit the scope thereof. In the examples, "parts" are by weight unless otherwise stated.

Example 1

(1) Fabrication of Substrate

Wood pulp composed of 100 parts of LBKP was refined to 300 cc of Canadian freeness by a double disk refiner. To this were added 0.5 parts of epoxidated behenic amide, 1.0 parts of anion polyacrylamide, 0.1 parts of polyamide polyamine epichlorohydrin and 0.5 parts of cation polyacrylamide, each in bone-dry weight ratio with respect to the pulp. Base paper of a weight of 100 g/m$^2$ was manufactured by a Fourdrinier paper machine, surface thereof was sized with polyvinyl alcohol at a bone-dry weight of 1.0 g/m$^2$, and the density was adjusted by calendering treatment to 1.0.

Corona discharge treatment was conducted on a wire surface (rear surface) side of the above-described base paper. Then, a high density polyethylene was coated by using a melt-extruder to a resin thickness of 30 $\mu$m to form a resin layer having a matte surface (which surface is referred to as the rear surface) Corona discharge treatment was conducted on the polyethylene-coated surface of this rear surface. Then, aluminum oxide ("Aluminasol 100" manufactured by Nissan Chemical Industries, Ltd) /silicon dioxide ("Snowtex O" manufactured by Nissan Chemical Industries, Ltd) in a ratio of 1/2 (by weight) was dispersed in water and coated at a weight of 0.2 g/m$^2$ after drying as an antistatic agent (this is referred to as rear PE lamination).

Further, corona discharge treatment was conducted on a felt surface (front surface) side of the base paper. A low density polyethylene containing 10% by weight of titanium dioxide and a trace amount of an ultramarine was melt-extrusion-coated using a melt-extruder to a resin thickness of 40 $\mu$mto form a resin layer having a gloss surface (this surface is referred to as the face surface). Corona discharge treatment was conducted on the polyethylene-coated surface of the face surface. Then, gelatin was coated as a primer coating at a weight after drying of 0.1 g/m$^2$.

(2) Preparation of Primer Layer Solution 97.5 parts by weight of water was added to 2.5 parts by weight of swellable synthetic mica "ME 100" (manufactured by Co-op Chemical Co., Ltd.), and the mixture was dispersed by a Dynamill. 100 g of the resulting mixture was added to 200 g of a 5% by weight aqueous solution of gelatin at 40° C. and stirred for 30 minutes. 20 cc of Surfactant-1 (5% by weight), described below, was added to obtain a primer layer solution.

Surfactant-1

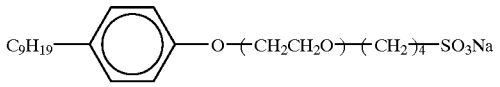

(3) Preparation of Cyan Heat-sensitive Recording Layer Solution

<Preparation of Capsule Solution Containing Electron Donative Dye Precursor>

(i) Solution A 5 parts of 3-(o-methyl-p-dimethylaminophenyl)-3-(1'-ethyl-2'-methylindol-3-yl)phthalide (electron donative dye precursor) was dissolved in 20 parts of ethyl acetate. Then, 20 parts of an alkyl naphthalene (high boiling point solvent) was added to the mixture. The mixture was heated and mixed uniformly.

20 parts of a 1/3 adduct of xylylene diisocyanate/trimethylolpropane was added to the resulting solution and the mixture was stirred uniformly to prepare Solution A.

(ii) Solution B 2 parts of a 2% by weight aqueous solution of sodium dodecysulfonate was added to 54 parts of a 6% by weight aqueous solution of gelatin phthalate to prepare Solution B.

Solution A was added to Solution B, and the mixture was emulsion-dispersed using a homogenizer to obtain an emulsified dispersion. To the resulting emulsified dispersion was added 68 parts of water. After uniform mixing, then, the mixture was heated to 50° C. while being stirred. A capsulation reaction was conducted for 3 hours to provide a capsule solution wherein the average particle size of the microcapsules was 1.2 $\mu$m.

<Preparation of Image Forming Agent-emulsified Dispersion>

2.5 parts of 1,1-(p-hydroxyphenyl)-2-ethylhexane (image forming agent), 0.3 parts of tricresyl phosphate and 0.1 parts of diethyl maleate were dissolved in 10 parts of ethyl acetate. The resulting solution was added to a solution prepared by mixing 20 parts of a 6% by weight aqueous solution of gelatin and 2 parts of a 2% by weight aqueous sodium dodecylsulfonate solution. The resulting mixture was emulsified for 10 minutes using a homogenizer to obtain an emulsified dispersion.

<Preparation of Coating Solution>

To the previously prepared capsule solution containing an electron donative dye precursor was added SBR latex (SN-307, manufactured by Sumitomo Norgatack) in an amount of 40% by weight with respect to the solid components of the capsule solution. Then, the image forming agent emulsified dispersion was mixed with the capsule solution containing the electron donative dye precursor in a ratio by weight of 1/4 to obtain a cyan layer coating solution.

(4) Preparation of Magenta Heat-sensitive Recording Layer Solution

<Preparation of Capsule Solution Containing Diazo Compound>

2.0 parts of a diazo compound (1) (decomposable by light having a wavelength of 365 nm), represented by a structural formula below, was dissolved in 20 parts of ethyl acetate. Then, 20 parts of an alkyl naphthalene was also added, and the mixture was heated and mixed uniformly. To the resulting solution was added 15 parts of a 1/3 adduct of xylylene diisocyanate/trimethylolpropane (capsule wall agent), and the mixture was mixed uniformly to obtain a solution of the diazo compound.

The resulting solution of the diazo compound was added to a solution prepared by mixing 54 parts of a 6% by weight aqueous solution of gelatin phthalate and 2 parts of a 2% by weight aqueous sodium dodecylsulfonate solution, and the mixture was emulsion-dispersed using a homogenizer.

To the resulting emulsified dispersion was added 68 parts of water. After uniform mixing, the mixture was heated to 40° C. while being stirred, and the capsulation reaction was conducted for 3 hours to provide a capsule solution wherein the average particle size of the capsules was 1.2 $\mu$m.

Diazo compound (1)

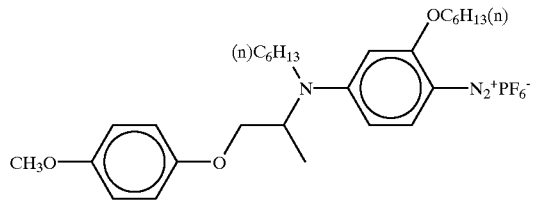

<Preparation of Coupler Emulsified Dispersion>

2 parts of a coupler (1) represented by a structural formula below, 2 parts of 1,2,3-triphenylguanidine, 0.3 parts of tricresyl phosphate and 0.1 parts of diethyl maleate were dissolved in 10 parts of ethyl acetate. The resulting solution was added to an aqueous solution prepared by mixing 20 parts of a 6% by weight aqueous solution of gelatin and 2 parts of a 2% by weight aqueous sodium dodecylsulfonate solution. Then, the mixture was emulsified for 10 minutes using a homogenizer to obtain an emulsified dispersion.

Coupler (1)

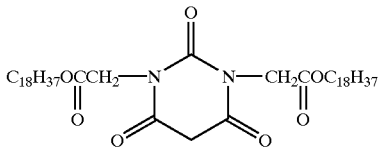

<Preparation of Coating Solution>

To the previously prepared capsule solution containing the diazo compound was added SBR latex (SN-307, manufactured by Sumitomo Norgatack) in an amount of 40% by weight with respect to the solid components of the capsule solution. Then, the coupler emulsified dispersion was mixed with the capsule solution containing a diazo compound in a ratio by weight of 3/2 to obtain a magenta layer coating solution.

(5) Preparation of Yellow Heat-sensitive Recording Layer Solution

<Preparation of Capsule Solution Containing Diazo Compound>

3.0 parts of 2,5-dibutoxy-4-tolylthiobenzenediazonium hexafluorophosphate (the diazo compound: decomposable by light having a wavelength of 420 nm) was dissolved in 20 parts of ethyl acetate. Then, 20 parts of an alkyl naphthalene was also added, to serve as a high boiling point solvent, and the mixture was heated and mixed uniformly.

To the resulting solution was added 15 parts of a 1/3 adduct of xylylene diisocyanate/trimethylolpropane as a capsule wall agent, and the mixture was mixed uniformly to obtain the solution of the diazo compound.

The resulting solution of the diazo compound was added to a solution prepared by mixing 54 parts of a 6% by weight aqueous solution of gelatin phthalate and 2 parts of an aqueous sodium dodecylsulfonate solution, and the mixture was emulsion-dispersed using a homogenizer.

To the resulting emulsified dispersion was added 68 parts of water. After uniform mixing, the mixture was heated to 40 ° C. while being stirred, and the capsulation reaction was conducted for 3 hours to provide a capsule solution whrein the average particle size of the capsules was 1.3 $\mu$m.

<Preparation of Coupler Emulsified Dispersion>

2 parts of 2-chloro-5-(3-(2,4-di-tert-pentyl) phenoxypropylamino)acetoacetoanilide, 1 part of 1,2,3-triphenylguanidine, 0.3 parts of tricresyl phosphate and 0.1 parts of diethyl maleate were dissolved in 10 parts of ethyl acetate. The resulting solution was added to an aqueous solution prepared by mixing 20 parts of a 6% by weight aqueous solution of gelatin and 2 parts of a 2% by weight aqueous sodium dodecylsulfonate solution. Then, the mixture was emulsified for 10 minutes using a homogenizer to obtain an emulsified dispersion.

<Preparation of Coating Solution>

The coupler emulsified dispersion prepared previously was mixed with the capsule solution containing the diazo compound in a ratio by weight of 3/2 to obtain a yellow layer coating solution.

(6) Preparation of Intermediate Layer Solution

To 10 parts of a 15% by weight aqueous solution of a gelatin (trade name: "#750", manufactured by Nitta Gelatin K.K.) was added 3 parts by weight of a 15% by weight aqueous solution of a polyacrylic acid (trade name: Jurimer AC-10L, manufactured by Nippon Junyaku K.K.). The mixture was mixed uniformly to obtain an intermediate layer solution.

(7) Preparation of Light Transmittance Controlling Layer Coating Solution 1.5 parts of a compound (A), shown below, 0.5 parts of R-6 as a reducing agent, 6.0 parts of ethyl acetate and 0.8 parts of tricresyl phosphate were mixed thoroughly and dissolved. 3.0 parts of xylylene diisocyanate/trimethylolpropane (75% ethyl acetate solution: manufactured by Takeda Chemical Industries, Ltd.; "Takenate D110N"), to serve as a capsule wall agent, was added to this solution, and the mixture was stirred until becoming homogeneous. 29.7 parts of an 8% by weight aqueous solution of carboxy-denatured polyvinyl alcohol (manufactured by Kuraray Co., Ltd.; "KL-318") was prepared, added to the above-described solution, and emulsion-dispersed by a homogenizer. The resulting emulsion was added to 40 parts of ion-exchanged water and stirred for 3 hours at 40° C. to conduct a capsulation reaction. Thereafter, 7.0 parts of an ion-exchanged resin "Amberlite MB-03" (manufactured by Organo Corp.) was added and the mixture was stirred further for 1 hour. The required coating solution was thus prepared. The average particle size of the capsules was 0.35 $\mu$m.

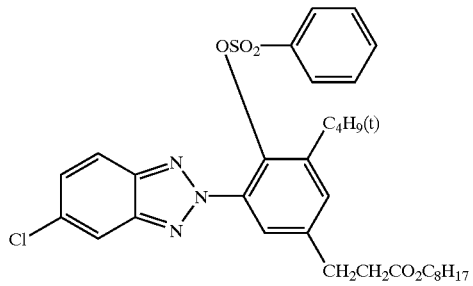

R-6

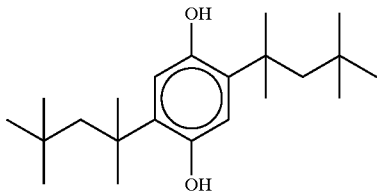

(8) Preparation of Protective Layer Solution

| | |
|---|---|
| EP130 (7% by weight) | 100 g |
| Water | 50 g |
| Selosol 524 (30% by weight) | 5 g |
| Barifine BF21F dispersion (20% by weight) | 10 g |
| Surfactant-1 (2% by weight) | 5 ml |
| Surfactant-2 (5% by weight) | 5 ml |

Herein, "EP130" is an dodecyl-denatured polyvinyl alcohol manufactured by Denki Kagaku Kogyo K.K., "Selosol 524" is a carnauba wax manufactured by Chukyo Yushi K.K., and "Barifine BF21F" is barium sulfate ultrafine particles manufactured by Sakai Chemical Industry Co., Ltd. The above-described "Surfactant-2" is represented by the following structural formula.

Surfactant-2

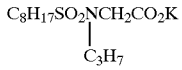

(9) Fabrication of Heat-sensitive Recording Material

At the face surface of the paper substrate laminated with polyethylene, the primer layer solution, cyan heat-sensitive recording layer solution, intermediate layer solution, magenta heat-sensitive recording layer solution, intermediate layer solution, yellow heat-sensitive recording layer solution, light transmittance controlling layer solution and protective layer solution were coated as multiple layers in that order from the substrate, and dried to obtain a Multicolor heat-sensitive recording material 100.

The coating amounts, converted to solid componetns after drying and in sequence from the substrate, were 1.0 g/m$^2$ for the primer layer, 6.1 g/m$^2$ for the cyan heat-sensitive recording layer, 1.0 g/m$^2$ for the intermediate layer, 7.8 g/m$^2$ for the magenta heat-sensitive recording layer, 1.0 g/m$^2$ for the intermediate layer, 7.2 g/m$^2$ for the yellow heat-sensitive recording layer, 1.5 g/m$^2$ for the light transmittance controlling layer, and 1.2 g/m$^2$ for the protective layer.

Example 2

[Preparation of protective layer coating solution]

| | |
|---|---|
| EP130 (7% by weight) | 100 g |
| Water | 52 g |
| Selosol 524 (30% by weight) | 5 g |
| Barifine BF21F dispersion (20% by weight) | 5 g |
| Snowtex C (20% by weight) | 5 g |

(colloidal silica dispersion; manufactured by Nissan Chemical Industries, Ltd)

| | |
|---|---|
| Surfactant-1 (2% by weight) | 10 ml |
| Surfactant-2 (5% by weight) | 10 ml |
| Surflon S131 (30% by weight) | 1.5 g |

(fluorine-based surfactant; manufactured by Asahi Glass Co., Ltd.)

A heat-sensitive recording material was fabricated in the same manner as in Example 1 except that the composition of the protective layer coating solution was as described above.

Example 3

[Preparation of Protective Layer Coating Solution]

| | |
|---|---|
| EP130 (7% by weight) | 100 g |
| Water | 50 g |
| Selosol 524 (30% by weight) | 5 g |
| Zinc stearate (21% by weight) | 5 g |
| Barifine BF21F dispersion (20% by weight) | 10 g |
| Surfactant-1 (2% by weight) | 5 ml |
| Surfactant-2 (5% by weight) | 5 ml |
| Surflon S131 (30% by weight) | 1.5 g |

A heat-sensitive recording material was fabricated in the same manner as in Example 1 except that the composition of the protective layer coating solution was as described above.

Example 4

A heat-sensitive recording material was fabricated in the same manner as in Example 1 except that the Barifine BF21 dispersion was not added to the protective layer coating solution.

Comparative Example 1

[Preparation of Protective Layer Coating Solution]

| | |
|---|---|
| PVA217 (7% by weight) | 100 g |
| Water | 0.9 g |
| Surfactant-1 (2% by weight) | 10 ml |
| Surfactant-2 (5% by weight) | 5 ml |
| ME313 (3% by weight) | 20.0 g |

(fluorine-based oil: manufactured by Daikin Industries., Ltd.)

| | |
|---|---|
| Kaolin dispersion (20% by weight) (average particle size: 1.3 $\mu$m) | 10.0 g |
| Zinc stearate (20.5% by weight) | 5.0 g |

A heat-sensitive recording material was fabricated in the same manner as in Example 1 except that the protective layer coating solution was as described above.

Comparative Example 2

A heat-sensitive recording material was fabricated in the same manner as in Comparative Example 1 except that the Kaolin dispersion was not added.

Comparative Example 3

A heat-sensitive recording material was fabricated in the same manner as in Example 1 except that Selosol 524 was not added in the preparation of the protective layer solution.

Each heat-sensitive recording material obtained in the examples and the comparative examples was evaluated by the following evaluation method.

<Evaluation Method>

[Paper Feeding]

100 sheets of paper were printed sequentially by a video/digital printer "NC-5" manufactured by Fuji Photo Film Co., Ltd. In this procedure, the number of times paper feeding failures, such as simultaneous feeding of a plurality of sheets occurred, was counted. A smaller number means more satisfactory paper feeding.

[Gloss]

Gray printing was conducted by a digital printer "NC-300 D" manufactured by Fuji Photo Film Co., Ltd. Un-printed portions and printed portions were measured with a digital deformation glossmeter "UGV-5D" manufactured by Suga Shikenki K.K., for an incident angle of 20°. A larger number means a more satisfactory gloss.

[Dynamic Friction Coefficient with a Head]

A platen roll with a length of 30 cm and a rubber hardness of 60 degrees, and a heat-sensitive recording head with a length of 30 cm were used. A sample of A4 size was fed through longitudinally with a head pressure of 7 kg/cm, and gradation printing was conducted from Dmin to Dmax. The torque of the platen roll at this time was measured and converted into a dynamic friction coefficient. The maximum value of the dynamic friction coefficient was indicated.

[Surface Roughness (Ra)]

Surface roughness was measured using the apparatus described earlier, using the same method.

[Scratch Resistance]

The number of scratches on the print surface of sheets printed by the video/digital printer "NC-5" was evaluated visually. The value listed is the average scratch number for one sheet, calculated from the scratch numbers of five sheets of paper.

[Head Residue Adhesion]

Contamination that had adhered to a heat-sensitive head was evaluated visually. A complete absence of contamination was evaluated as ○, slight discernible contamination recognized was evaluated as Δ and obvious contamination was evaluated as X.

The evaluation results are shown in Table 2. In the table, in the column "surface roughness (Ra)", the value in the column "un-image-formed parts" indicates the surface roughness of a heat-sensitive recording material before printing.

TABLE 2

| | Number of paper feeding failures | Glossiness (%) Un-printed parts | Glossiness (%) Printed parts | Dynamic friction coefficient with a head | Surface roughness (Ra) Non-image-formed parts | Surface roughness (Ra) Image-formed parts | Head residue adhesion |
|---|---|---|---|---|---|---|---|
| Example 1 | 0 | 24.5 | 41.2 | 0.18 | 0.85 | 0.68 | ○ |
| Example 2 | 0 | 22.5 | 40.8 | 0.08 | 0.79 | 0.65 | ○ |
| Example 3 | 0 | 24.0 | 40.5 | 0.12 | 0.80 | 0.63 | ○ |
| Example 4 | 0 | 25.5 | 43.4 | 0.14 | 0.82 | 0.66 | ○ |
| Comparative example 1 | 0 | 3.2 | 12.1 | 0.22 | 1.25 | 0.95 | Δx |
| Comparative example 2 | 3 | 5.8 | 16.5 | 0.32 | 1.18 | 0.92 | x |
| Comparative example 3 | 3 | 6.0 | 18.2 | 0.35 | 1.20 | 0.90 | x |

It was apparent that the surface roughnesses of the heat-sensitive recording materials of Examples 1 to 4 were all less than 0.7 μm after printing, while the same of Comparative Examples 1 to 3 were over 0.7 μm after printing. In the heat-sensitive recording materials of all the Examples, paper feeding failure did not occur and paper feeding ability was satisfactory. Also, gloss was satisfactory, and the gloss figures for image-formed parts were markedly large. Further, the friction coefficients with heads were remarkably low compared with the comparative examples. Therefore, the travelling properties (feedabilities) were also satisfactory. Further, because of the low friction coefficients with heads, the friction resistances (friction with a heat-sensitive head during printing) were satisfactory, no noise occurred during printing and no printing misintegration occurred. Regarding head residue adhesion, no contamination adhered in any of the Examples. On the other hand, the heat-sensitive recording materials of Comparative Examples 1 to 3 had low glossiness on printed parts, had large dynamic friction coefficients with heads, and residue adhesion at heads was large. Further, with regard to scratch resistance, scratches did not occur for Examples 1 to 4, while occurrence of scratches was observed in the Comparative Examples.

As described above, the heat sensitive recording material according to the present invention has a characteristic that gloss is excellent, and particularly excellent on printed portions. Further, the heat sensitive recording material of the present invention has excellent head-related properties during printing. Specifically, the heat sensitive recording material of the present invention has a low friction coefficient with a head, has excellent travelling property, and excellent in friction resistance against a heat-sensitive recording head, lubricity and scratch resistance, and does not cause noise during printing or printing misintegration. Furthermore, a printing head is not contaminated by adhesion of residues. Further, when the heat sensitive recording material of the present invention is of transparent type, the transparency is excellent.

What is claimed is:

1. A heat-sensitive recording material comprising a substrate, a heat-sensitive recording layer provided on said substrate, and a protective layer provided on said heat-sensitive recording layer, wherein when an image is formed on said heat-sensitive recording material by an application energy of 120 $mJ/m^2$, a surface roughness of an image-formed surface of the heat-sensitive recording material after image forming is at most 0.7 μm.

2. A heat-sensitive recording material according to claim 1 wherein the surface roughness of the heat-sensitive recording material before image forming is at most 1.0 μm.

3. A heat-sensitive recording material according to claim 2 wherein a glossiness of the image-formed surface after image forming is at least 40% in terms of glossiness as defined in JIS Z-8741 for an angle of incidence of 20 degrees.

4. A heat-sensitive recording material according to claim 3 wherein said protective layer at least contains a long-chain alkyl ether-denatured polyvinyl alcohol, a wax, and inorganic ultra fine particles having an average primary particle size of at most 0.1 μm.

5. A heat-sensitive recording material according to claim 4 wherein said long-chain alkyl ether-denatured polyvinyl alcohol is an alkyl ether-denatured polyvinyl alcohol having 8 to 20 carbon atoms.

6. A heat-sensitive recording material according to claim 4 wherein said long-chain alkyl ether-denatured polyvinyl alcohol is a polymer represented by a general formula (A) as follows:

General formula (A)

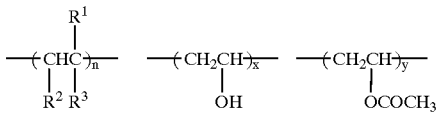

-continued

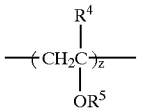

wherein, $R^1$ represents a hydrogen atom, a methyl group or —$CH_2CO_2M$; $R^2$ represents a hydrogen atom or —$CO_2M$; $R^3$ represents a hydrogen atom, —$CO_2M$, an amino group, an amide group, a substitutional amide group, a hydroxy group, a glycidyl group, a sulfonate group, a polyethylene oxide group, a polypropylene oxide group or a group carrying at least one of above-listed functional groups; $R^4$ represents a hydrogen atom or a methyl group; and $R^5$ represents an alkyl group having 8 to 20 carbon atoms, M represents a hydrogen atom, an alkyl group, an aryl group, an aralkyl group, a sodium atom, a potassium atom or a lithium atom, n, x, y and z each represent a degree of polymerization.

7. A heat-sensitive recording material according to claim 4 wherein said wax is carnauba wax.

8. A heat-sensitive recording material according to claim 4 wherein at said protective layer, the long-chain alkyl ether-denatured polyvinyl alcohol is used in combination with another aqueous binder.

9. A heat-sensitive recording material according to claim 8 wherein a component of the other aqueous binder is any of silicone-denatured aqueous polymers and ethylene-denatured polyvinyl alcohol.

10. A heat-sensitive recording material according to claim 1 wherein a glossiness of the image-formed surface after image forming is at least 40% in terms of glossiness defined in JIS Z-8741 for an angle of incidence of 20 degrees.

11.A heat-sensitive recording material comprising a heat-sensitive recording layer and a protective layer provided on a substrate, wherein said protective layer comprises at least long-chain alkyl ether-denatured polyvinyl alcohol, a wax, and inorganic ultra fine particles having an average primary particle size of at most 0.1 $\mu$m.

12. A heat-sensitive recording material according to claim 11 wherein said long-chain alkyl ether-denatured polyvinyl alcohol is an alkyl ether-denatured polyvinyl alcohol having 8 to 20 carbon atoms.

13. A heat-sensitive recording material according to claim 11 wherein said long-chain alkyl ether-denatured polyvinyl alcohol is a polymer represented by a general formula (A):

General formula (A)

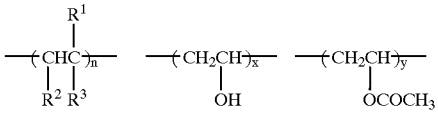

-continued

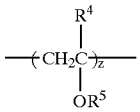

wherein, $R^1$ represents a hydrogen atom, a methyl group or —$CH_2CO_2M$; $R^2$ represents a hydrogen atom or —$CO_2M$; $R^3$ represents a hydrogen atom, —$CO_2M$, an amino group, an amide group, a substitutional amide group, a hydroxy group, a glycidyl group, a sulfonate group, a polyethylene oxide group, a polypropylene oxide group or a group carrying at least one of above-listed functional groups; $R^4$ represents a hydrogen atom or a methyl group; and $R^5$ represents an alkyl group having 8 to 20 carbon atoms, M represents a hydrogen atom, an alkyl group, an aryl group, an aralkyl group, a sodium atom, a potassium atom or a lithium atom, n, x, y and z each represent a degree of polymerization.

14. A heat-sensitive recording material according to claim 11 wherein said wax is carnauba wax.

15. A heat-sensitive recording material according to claim 11 wherein at said protective layer, the long-chain alkyl ether-denatured polyvinyl alcohol is used in combination with another aqueous binder.

16. A heat-sensitive recording material according to claim 15 wherein a component of the other aqueous binder is any of silicone-denatured aqueous polymers and ethylene-denatured polyvinyl alcohol.

17. A heat-sensitive recording material according to claim 11 wherein when said heat-sensitive recording material is image-formed by an application energy of 120 mJ/$m^2$, a surface roughness of an image-formed surface of the heat-sensitive recording material after image forming is at most 0.7 $\mu$m or less.

18. A heat-sensitive recording material according to claim 17 wherein the surface roughness of the heat-sensitive recording material before image forming is at most 1.0 $\mu$m.

19. A heat-sensitive recording material according to claim 18 wherein a glossiness of the image-formed surface after image forming is at least 40% in terms of glossiness as defined in JIS Z-8741 for an angle of incidence of 20 degrees.

20. A heat-sensitive recording material according to claim 11 wherein said protective layer contains an amount of the long-chain alkyl ether-denatured polyvinyl alcohol of at least 50% by weight.

21. A heat-sensitive recording material according to claim 11 wherein the long-chain alkyl ether-denatured polyvinyl alcohol has a glass transition temperature of at least 50° C.

* * * * *